US011937627B2

(12) United States Patent
Sullivan

(10) Patent No.: US 11,937,627 B2
(45) Date of Patent: Mar. 26, 2024

(54) CONE LOADING, WEIGHING, FILLING, AND TWISTING APPARATUS AND METHOD FOR MASS PRODUCTION OF SMOKABLE CANNABIS OR HEMP PRODUCTS

(71) Applicant: John Timothy Sullivan, Marriottsville, MD (US)

(72) Inventor: John Timothy Sullivan, Marriottsville, MD (US)

( * ) Notice: Subject to any disclaimer, the term of this patent is extended or adjusted under 35 U.S.C. 154(b) by 213 days.

(21) Appl. No.: 16/856,271

(22) Filed: Apr. 23, 2020

(65) Prior Publication Data

US 2021/0022388 A1 Jan. 28, 2021

Related U.S. Application Data

(60) Provisional application No. 62/995,884, filed on Feb. 19, 2020, provisional application No. 62/922,056, filed on Jul. 23, 2019.

(51) Int. Cl.
*A24C 5/02* (2006.01)
*A24C 5/32* (2006.01)
(Continued)

(52) U.S. Cl.
CPC ..... *A24C 5/02* (2013.01); *A24C 5/32* (2013.01); *A24C 5/46* (2013.01); *A24C 5/54* (2013.01); *A24C 5/60* (2013.01); *A24C 5/35* (2013.01)

(58) Field of Classification Search
CPC .... A24C 5/02; A24C 5/06; A24C 5/14; A24C 5/35; A24C 5/39; A24C 5/393;
(Continued)

(56) References Cited

U.S. PATENT DOCUMENTS 4,782,644 A * 11/1988 Haarer ..... B65B 1/363 53/900
2001/0010284 A1* 8/2001 Hebels ..... A24C 5/352 198/570

(Continued)

FOREIGN PATENT DOCUMENTS

DE 102016218298 A1 * 3/2018 ..... B25J 15/022

OTHER PUBLICATIONS

Mangold, Simone, "Machine translation of DE 102016218298 A1," Espacenet.com, Translated Mar. 22, 2022. (Year: 2022).*

(Continued)

*Primary Examiner* — Philip Y Louie
*Assistant Examiner* — Sonny V Nguyen
(74) *Attorney, Agent, or Firm* — BACON & THOMAS, PLLC

(57) ABSTRACT

An apparatus for mass producing smokable products filled with cannabis, hemp, and/or other smokable materials includes a cone loading station that separates individual paper cones from stacks of cones, a cone weighing and filling station for dispensing precisely weighed amounts of powdered biomass into the cones, and a cone twisting station for twisting ends of the cones to complete the smokable products. A transport mechanism is provided to transfer the cones between stations and hold the cones during filling and twisting. The invention also provides a method of manufacturing smokable products that enables production steps to be performed simultaneously while also providing for capacity expansion within a limited production facility footprint.

29 Claims, 29 Drawing Sheets

(51) Int. Cl.

| | |
|---|---|
| ***A24C 5/46*** | (2006.01) |
| ***A24C 5/54*** | (2006.01) |
| ***A24C 5/60*** | (2006.01) |
| *A24C 5/35* | (2006.01) |

(58) Field of Classification Search
CPC ..... A24C 5/394; A24C 5/395; A24C 5/46; A24C 5/54; A24C 1/02
See application file for complete search history.

(56) References Cited

U.S. PATENT DOCUMENTS

| | | | | |
|---|---|---|---|---|
| 2008/0142029 | A1* | 6/2008 | Ott | A24C 5/39 131/369 |
| 2014/0261469 | A1* | 9/2014 | Kissling | A24C 5/40 131/108 |
| 2018/0075710 | A1* | 3/2018 | Rees | G07D 11/23 |
| 2019/0320707 | A1* | 10/2019 | Boucher | A24C 5/06 |
| 2019/0320708 | A1* | 10/2019 | Boucher | A24C 5/44 |
| 2019/0320710 | A1* | 10/2019 | Sirois | A24C 5/12 |
| 2019/0329514 | A1* | 10/2019 | Holderman | B65B 43/60 |
| 2019/0381670 | A1* | 12/2019 | Correll | B25J 9/106 |
| 2020/0068947 | A1* | 3/2020 | Leadbeater | A24C 5/398 |
| 2021/0030054 | A1* | 2/2021 | Godwin | A24C 5/02 |
| 2021/0094189 | A1* | 4/2021 | Zhang | B25J 15/022 |
| 2021/0177045 | A1* | 6/2021 | Mullen | A24C 5/54 |
| 2021/0337733 | A1* | 11/2021 | Dondeyne | A01D 46/30 |

OTHER PUBLICATIONS

TLX Technologies, "Solenoid 101: What is a Solenoid?," Published Aug. 25, 2012, <https://www.tlxtech.com/articles/solenoid-101-what-is-a-solenoid>. (Year: 2012).*

* cited by examiner

CONE LOADING, WEIGHING, FILLING, AND TWISTING APPARATUS AND METHOD FOR MASS PRODUCTION OF SMOKABLE CANNABIS OR HEMP PRODUCTS

This application claims the benefit of U.S. Provisional Patent Appl. Ser. Nos. 62/922,056, filed Sep. 23, 2019, and 62/995,884, filed Feb. 19, 2020, each of which is incorporated by reference herein.

BACKGROUND OF THE INVENTION

1. Field of the Invention

This invention relates to an apparatus for loading smokable materials into paper cones, and for manipulating the cones to form smokable products.

The invention also relates to a method of mass producing smokable products in a modular production facility, the method including steps of continuously weighing and dispensing smokable materials into paper cones or similar combustible receptacles held at a first station, and transporting the filled cones or receptacles to a second station at which ends of the cones or receptacles are twisted to form the smokable products while additional cones or receptacles are being filled at the first station, the production capacity optionally being expandable without a corresponding increase in production facility area by utilizing an orbital transport architecture in which the stations are arranged circumferentially around the conveyance mechanism.

The smokable materials may include powdered cannabis or hemp-derived substances.

The apparatus may include stations and/or devices for separating individual paper cones from a stack, weighing and loading the cannabis or hemp powders into individual cones, twisting the cones to form the smokable products, and packaging the finished smokable products.

Although the description below refers to cannabis or hemp, the smokable materials are not limit to cannabis or hemp, but may include tobacco and other smokable substances, as well as mixtures of smokable materials, with or without additives such as resins.

In addition, the invention is not limited to filling of paper cones, but may include receptacles for the smokable materials having shapes other than cones, including cylindrical or frustoconical shapes, as well as receptacles made of combustible sheet materials other than paper.

2. Description of Related Art

Conventionally, smokable cannabis products (hereinafter referred to as cannabis products) were produced by manually weighing and hand-rolling the products, a labor intensive process resulting in high costs and/or a lack of uniformity. Because both cannabis and hemp products were generally illegal, mass production was not feasible. However, recent legalization of hemp products and cannabis in a number of jurisdictions for both medical and recreational purposes has made mass production viable, and also increased the need for uniformity in composition, weight, and packaging of the products.

In contrast to smokable cannabis products, smokable tobacco products have been mass produced for more than a century. However, conventional cigarette and cigar manufacturing apparatus and techniques cannot easily be adapted for the manufacture of smokable cannabis products such as the cigarette-like products known by a variety of names, including "joints," "blunts," and "spliffs." One reason is the diversity of materials that can be included in a marijuana cigarette, which include not just the paper, dried leaves, and filters of typical tobacco cigarettes, but also materials derived from different strains and parts of the cannabis plant, with different ratios of active ingredients that vary in density and composition and that, unlike tobacco products, are intended for medical as well as recreational use. Additional reasons why tobacco cigarette or cigar production technology cannot easily be applied to cannabis products is the need for strict control of product weight, because small differences in the amount of cannabis consumed can cause substantially different effects and consequences, and cannabis products are subject to strict legal restrictions concerning the amount of cannabis that can be purchased or possessed by individuals.

The conventional labor intensive method of manufacturing smokable cannabis products in amounts of up to thousands of cones per hour is to grind the cannabis flowers and leaves into fine powders, and to measure the powders into paper cones that are hand-twisted to produce the smokable product, with or without added cannabis oils, resins, or crystal isolates. Since the majority of the loading, weighing, and rolling or twisting is done entirely by hand, it is very difficult to achieve uniformity, especially considering that the weight of cannabis materials in each individual product is extremely small, in the 0.5 to 4 gram range.

To ensure greater uniformity of powders within the cones, some companies have designed holders for the cones, which are shaken using electromagnetic or air-driven vibrators after being loaded manually or by an automated dispenser. However, when loaded in this manner, the vibration will cause some product to fall around the corners or spill outside the cones. This not only results in waste, but also can invite theft and black market sale of the spilled product.

It has also been proposed to mechanize the twisting process. One company, for example, has developed a twister that utilizes rubber twister fingers driven by a friction cam driven by air cylinders. However, the use of rubber (or similarly soft plastic materials such as urethane, is that the friction fingers tend to wear out at high production speeds and cycles, shortening the life of the twisting equipment and resulting in an inconsistent twist. If the torque on the paper twist is too low, the fine cannabis powder will leak out of the cone, but if the torque is too high, the cone will tear and the fine powder will also leak out of the cone.

As a result, novel methods and apparatus are required for the mass production of smokable cannabis products.

SUMMARY OF THE INVENTION

It is accordingly a first objective of the invention to provide an apparatus that overcomes the disadvantages of conventional smokable cannabis product manufacturing methods and devices, and enables mass production of smokable cannabis products.

It is a second objective of the invention to provide an apparatus for mass production of smokable cannabis products that provides improved handling of receptacles, such as paper cones, for the smokable cannabis materials, as well improved handling of the smokable cannabis products themselves, to achieve reduced waste and increased production efficiency and product uniformity.

It is a third objective of the invention to provide an apparatus that enables automated weighing of smokable cannabis materials with improved accuracy, and that also enables automated loading of smokable cannabis materials into cones without spillage or escape of powdered cannabis material from the loaded cones.

It is a fourth objective of the invention to provide an apparatus that automatically twists a cannabis-filled paper cone or other receptacle without tearing.

It is a fifth objective of the invention to provide fully automated cannabis product manufacture that begins with separation of individual cones from a stack, followed by automated weighing of cannabis materials and filling of the individual cones, twisting of the cones, and dispensing of the cones into child proof packages.

It is a sixth objective of the invention to provide a cannabis process method that enables several steps in the formation of smokable cannabis products to be carried out simultaneously, and that optional permits expansion of production capacity within a limited apparatus footprint.

These and other objectives are achieved, in accordance with preferred embodiments of the invention, by providing an apparatus that includes a cone loading station, a cone weighing and filling station, a cone twisting station, and a cone discharge station, all connected by a conveyor that includes a plurality of split clamshell holders mounted on arms that extend from a computer controlled turntable.

The objectives of the invention are also achieved by a method of producing smokable materials in which cone loading, weighing and filling, cone twisting, and cone discharge are carried out simultaneously at the respective stations, and which expansion of production capacity is achieved by duplicating the stations and increasing the number of holders and arms arranged around the turntable.

In an illustrated embodiment of the invention, the cone loading station includes a plurality of tubes, each holding a stack of cones and mounted on a chain that transports the tubes to at least one loading station having a gripper that grips an end of one of the cones, and pulls it from a tube to a position where it can be held by one of the split clamshell holders for transport to a weighing and filling station. A reduced diameter section or washer-like structure a hole that is between 0.125 and 0.250 inches at the base of each tube causes friction against the cone as it is pulled out of the transport tube to ensure that only one cone is pulled out at a time. Added friction can also be applied by a mechanical pinch.

In further illustrated embodiments, the cone weighing and filling station includes a vibrating plate and a rotating grooved cylinder/auger for conveying units of powered cannabis material to a cantilevered cup or bowl supported by at least one load cell for weighing and dispensing into individual cones, or a vibrating plate, rotating grooved cylinder/auger and rotating wheel for simultaneously weighing units of powdered cannabis can conveying the units to the paper cones.

In the illustrated weighing and filling stations, the problem of escape of powder during vibration is addressed by adding a receiving funnel that is downwardly movable into the into a respective cone using a linear stage motor while vibrating the cones to ensure that all of the weighted product goes into the cone without spillage. Preferably, the weighing cup uses computer-controlled timing to drive the receiving funnel into the cone when the correct weight has been dispensed from the load cell. In addition, a vacuum may be applied to the bottom of the cone through the cone's internal filter to more rapidly settle the irregularly shaped biomass into the cones at a higher rate of nesting and thereby increase production speed.

In an alternative embodiment of a weighing and filling mechanism, a variable speed waterwheel type device including a rotating wheel with individual compartments, whose collective weight is borne by a load cell, is used to continuously weigh and dispense biomass into a vibrating funnel to load the paper cones. The vibrating funnel prevents powder clogging, while a compacting auger imparts rotation to the powdered biomass as it enters the cone to expedite filling and settling of the powdered biomass before twisting the cone to complete production. Preferably, the imparted rotation is in the direction of the natural Coriolis force to optimize packing efficiency and clogging prevention.

According to another feature of the preferred embodiment of the invention, the apparatus of the invention includes a cone twisting mechanism having a novel gripper structure that address the problem of friction finger wear by utilizing grippers that employ stepper motors, a servo motor, shaft encoders, adjustable magnetic torque limiters, motor current sensors and software to control and maintain a perfect twist on the fragile paper of the cone. Preferably, the software is designed to step from a home position sensor or shaft encoder to the location of the desired jaw-closing range to ensure the same amount of steps or rotation encoder counts are repeated each time to ensure a perfect twisting angle or, alternatively, an adjustable magnetic slip clutch may be allowed to slip at the desired torque, allowing the spinning gripper to come to rest upon completion of twist while the gripper jaws are opened and closed by a separate motor so that the gripper jaws are open and ready to grip another cone upon return to the home position. In addition, a pinch pin may be provided to preventing rotation of the cone in the holder during twisting.

As illustrated, the gripper assemblies of the cone twisting mechanism may employ three stepper or servo motors, with the motor that spins the gripper having a hollow shaft that allows the gripper motor to pass through the spinner motor and independently open and close the gripper jaws while a third motor adjusts the relative vertical positions of the cone and gripper using sensors that detect the correct twister height for different cones and a software look-up table of height to cone sizes, so that the twister can be used for different cone dimensions.

According to additional features of the illustrated cone twisting mechanism, the gripper fingers or jaws can be spring loaded or fixed. In one embodiment, the gripper assembly includes a cam follower driven by a threaded motor shaft and linear bearing that opens and closes the jaws by turning the off thread with an externally threaded bearing assembly that allows the jaw assembly to spin when the jaws are opened and closed. The jaw assembly may be moved on the threaded cam hub assembly using cam-driven connection arms. Software timing can control the spin and direction of the threaded shaft and the rotation of the assembled motor to account for friction between the threaded cam hub assembly to make sure the jaws do not open or close while the jaw assembly is spinning.

In yet another alternative twisting mechanism gripper design, a linear motor passes through a hollow shaft motor that uses a linear motion to open and close the jaws by moving a fixed rotation jaw assembly arranged to slide up and down on three supporting linear bearings situated 120 degrees apart. In this alternative, the linear motor is connected to a shaft with bearing that allows the jaw assembly to rotate while the three jaws open and close.

According to additional features of the illustrated apparatus, the split clamshell-type cone holders are mounted on a rotating stepper or servo motor platform and have spring-loaded linear bearings and a mechanical cam that makes contact with a cam follower bearing to cause the split clamshell-type cone holders to open and drop a respective twisted cone into a funnel or trough and then into appropriate packaging, for example a childproof tube with a cap, without the need for additional electronics. A conveyor then carries the packaged twisted cone to a labeling machine.

As an alternative to the split clamshell-type cone holders, the cone holders may utilize pivoting jaws held in a closed position by a compression spring and opened by a solenoid device.

As an alternative to the pivoting cup and water wheel weighing and filling mechanism, a diverter wheel that switches rotation directions may be used to direct the biomass into alternate hoppers for weighing before dispensing into a funnel.

Optionally, a hypodermic needle driven by a linear motor may be provided at the weighing and filling station to inject a resin or crystal isolate into the twisted cone to improve the quality of the product. A liquid nitrogen spray can be sprayed before removing the needle from the cone and a wiper used to remove the powdered cannabis and resin from the tip, by freezing any adhered power and resin so that it falls back into the cone before it is twisted.

Although the exemplary embodiments of the invention involve arrangement of the stations circumferentially around a turntable, it will be appreciated that the stations could also be arranged linearly in conventional assembly line fashion.

BRIEF DESCRIPTION OF THE DRAWINGS

FIGS. 31-33 are isometric views showing operation of the vertically movable funnel used in the powder weighing and dispensing mechanism illustrated in FIGS. 26-29.

FIG. 34 is a top view of the powder weighing mechanism illustrated in FIGS. 26-29.

DETAILED DESCRIPTION OF THE PREFERRED EMBODIMENTS

Figure 1:
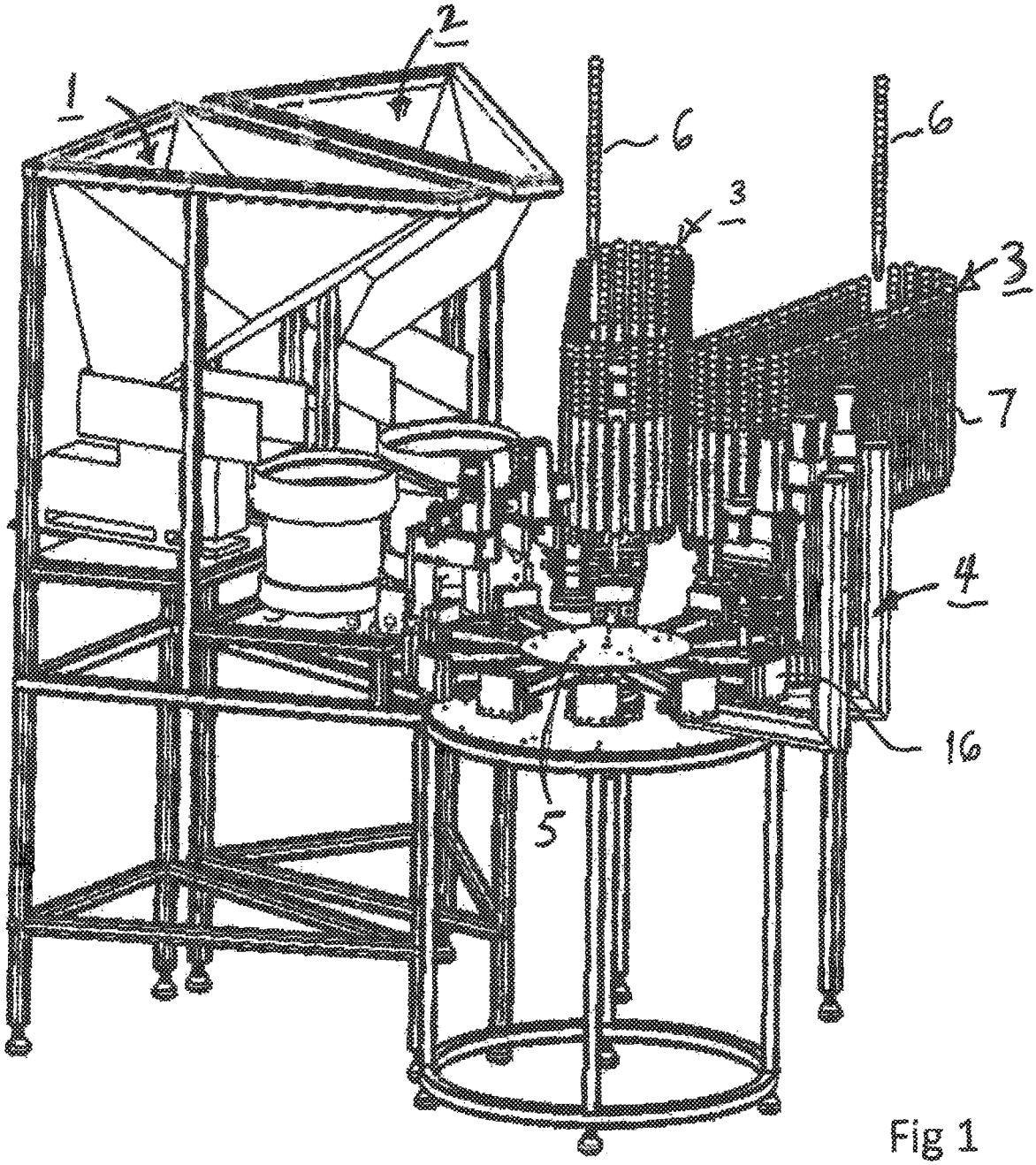
FIG. 1 is an isometric view of a smokable cannabis product mass-production apparatus constructed in accordance with principles of a preferred embodiment of the invention.

FIG. 1 shows an exemplary mass production facility for smokable cannabis products, constructed in accordance with principles of preferred embodiments of the invention. The apparatus includes a powder weighing and cone-filling station 1,2, a cone loading station 3, a cone twisting station 4, and a computer controlled turntable 5 for moving split clamshell holders 16 to transport cones between respective stations. Various embodiments or versions of the cone loading station 3 are illustrated in greater detail in FIGS. 2-7, while embodiments or versions of the cone twisting station are illustrated in FIGS. 8-20, and mechanisms for use in the powder weighting and cone-filling station 1,2 are illustrated in FIGS. 21-34. FIGS. 35-41 illustrate additional features, options, or variations of the apparatus of FIG. 1.

Figure 40:
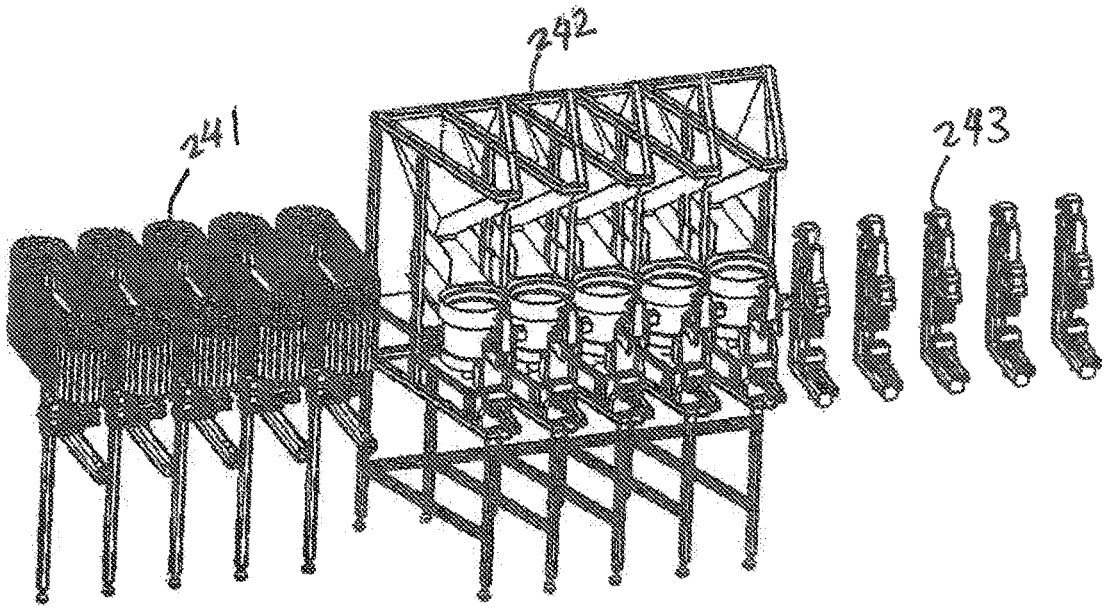
FIG. 40 is a perspective view of a variation of the apparatus of FIG. 1, in which multiple cone loading, filling, and twisting stations are arranged linearly in assembly-line fashion for parallel operation.

By arranging the respective stations 1-4 around the computer controlled turntable 5, the invention enables the various production steps to be carried out simultaneously, and production capacity to be multiplied in substantially the same production facility area by increasing the number of holders 16 and the number of each type of station 1-4 arranged around the turntable 5. On the other, if space is not a consideration, the various stations can also be arranged linearly as shown in FIG. 40, discussed below, or in some other geometric arrangement.

It will be appreciated by those skilled in the art that, even though a number of different embodiments, variations, options, and features of the mass production facility and its various stations are described in detail herein, the description is not to be taken as strictly limiting, and that further modifications and improvements may be made to the illustrated embodiments, variations, options, and features thereof without departing from the scope of the invention.

Figure 2:
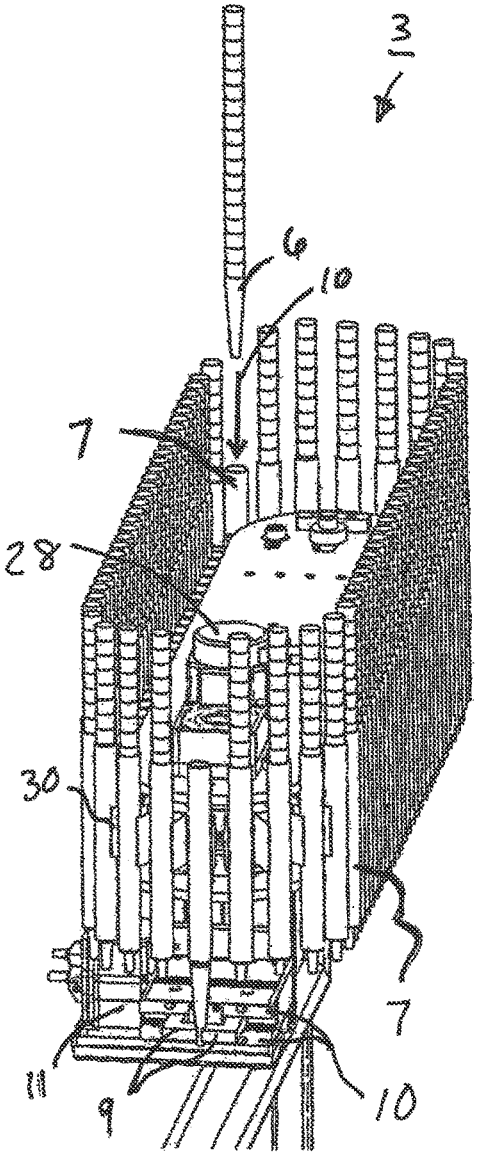
FIG. 2 is an isometric view of a cone stack transporting mechanism and loading station for use in the apparatus of FIG. 1.
Figure 3:
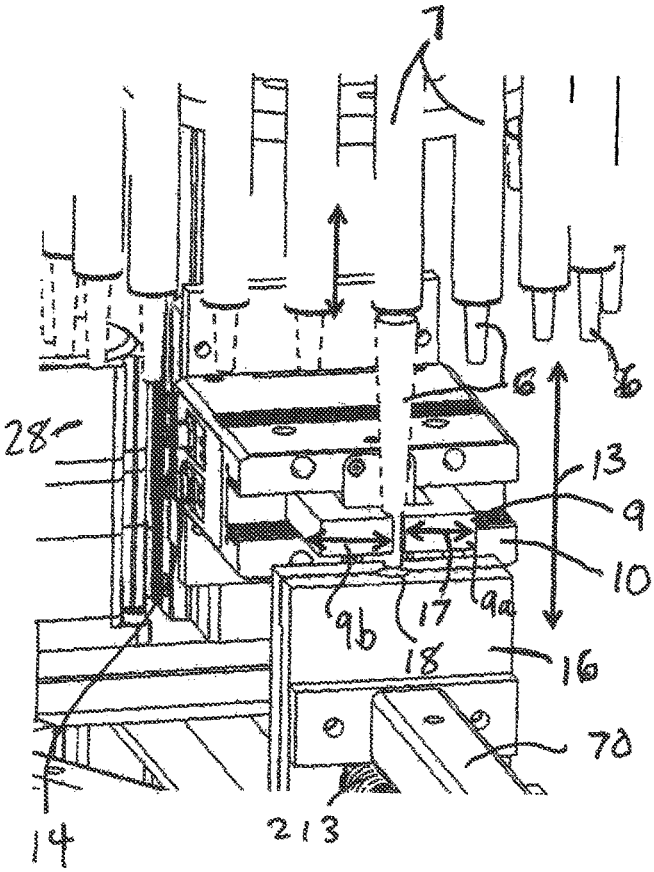
FIG. 3 is an isometric view of the cone loading station illustrated in FIG. 2.
Figure 4:
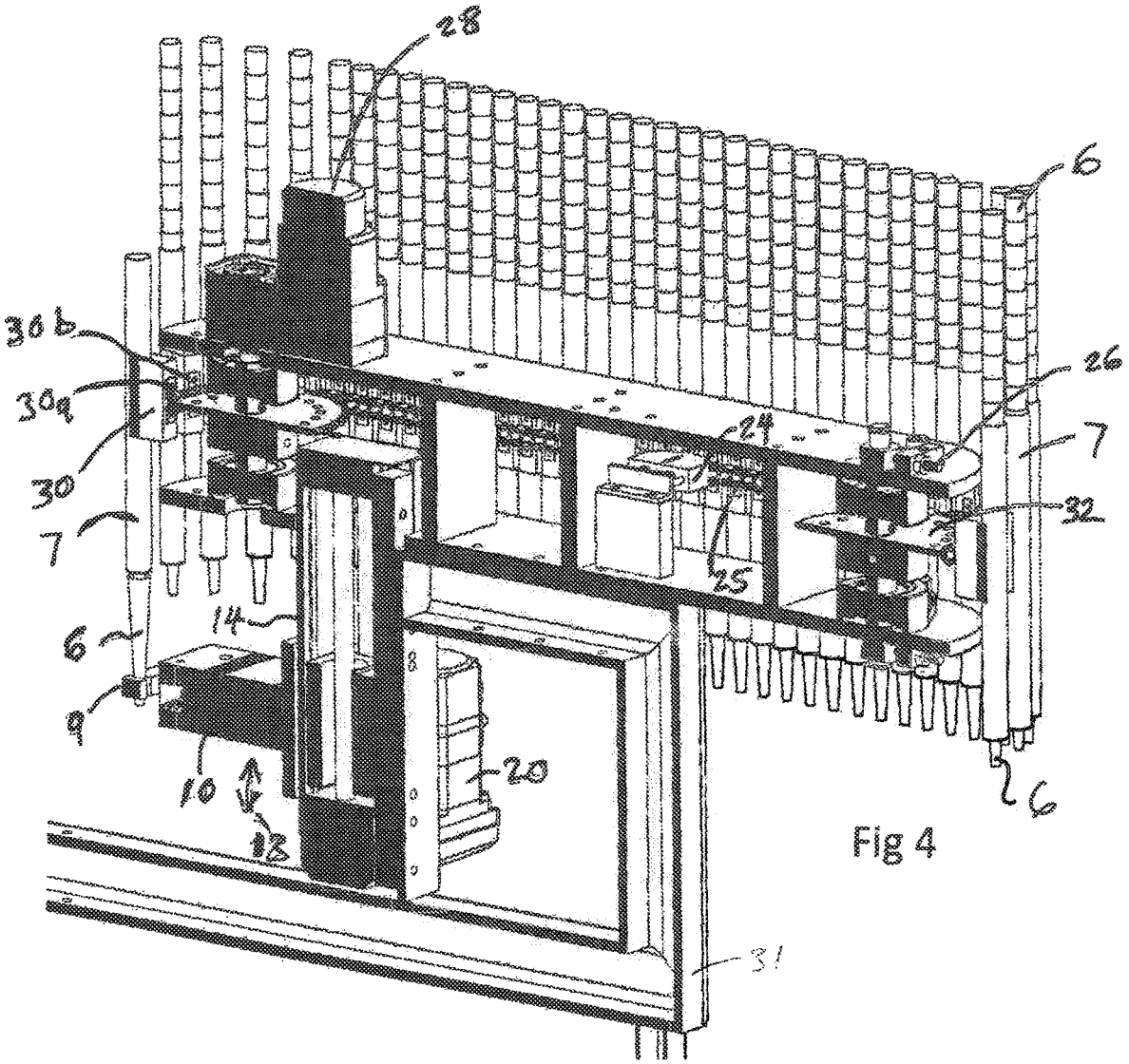
FIG. 4 is a cross-sectional view of the cone stack transporting mechanism and loading station of FIG. 2.
Figure 5:
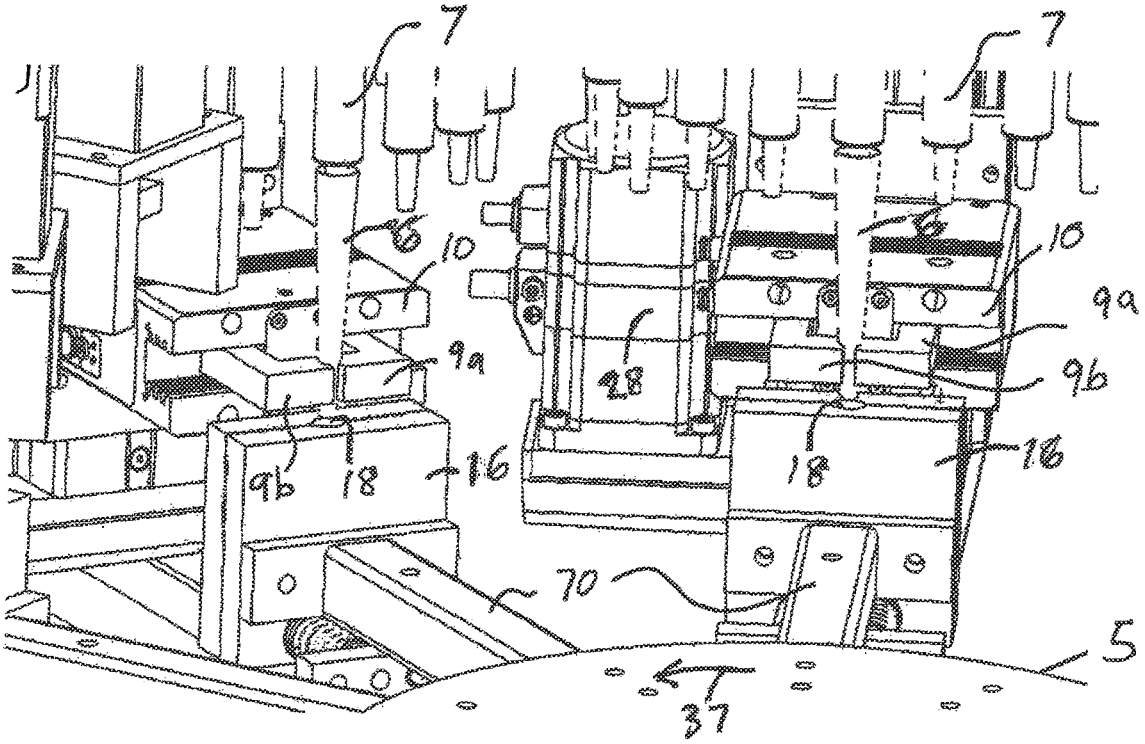
FIG. 5 is an isometric view of a variation of the cone loading station of FIG. 3.
Figure 6:
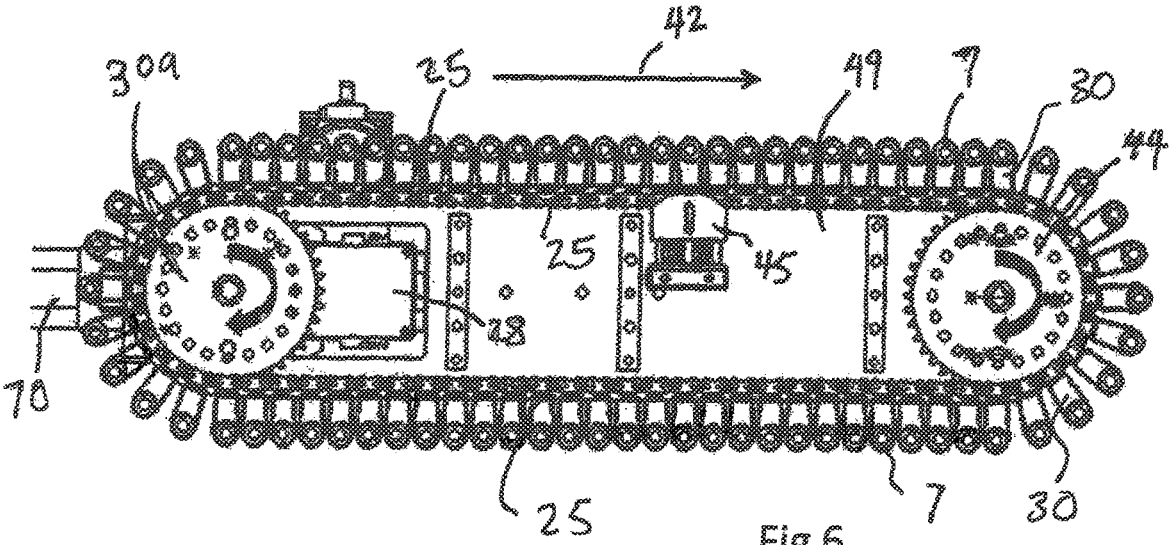
FIG. 6 is a bottom plan view of the cone loading station of FIG. 2.

As illustrated in FIGS. 2-7, the cone loading station 3 of the apparatus of FIG. 1 includes a plurality of tubes 7, each arranged to receive a stack of cones 6 for transport to a gripper 9 driven that pulls individual ones of the cones 6 from the tubes 7. Various embodiments of the gripper mechanism are illustrated in FIGS. 3-5, while FIG. 6 illustrates a preferred arrangement for retaining cones 12 in the tubes 7 and ensuring that only one of the cones 6 is pulled out at a time by the gripper 9. The stacks of cones 6 may be manually or automatically loaded into the tube 7 in the direction indicated by arrow 10.

In this embodiment, the tubes 7 are moved to a position adjacent the gripper 9 by a chain mechanism including a chain 25, motor 28 for driving the chain, and brackets 30 extending from the chain 25 for holding respective tubes during transport and withdrawal of the cones 6. Details of the chain driving mechanism are illustrated in FIG. 4.

As shown in FIG. 3, the gripper 9 is made up of jaws 9*a* and 9*b* arranged to move horizontally in opposite directions, as indicated by arrow 17, in response to a driving force provided by a linear actuator 10. Jaws 9*a* and 9*b* are also arranged to move collectively in a vertical direction indicated by arrow 13, in response to a driving force provided by a motor 20, illustrated in FIG. 4, which is arranged to move the entire linear actuator 10, including jaws 9*a* and 9*b* in the vertical direction 13 along a track 14. Initially, the jaws 9*a* and 9*b* are moved to an open position and the open jaws are moved together with actuator 10 to an upper position so that the jaws are situated on two sides of a cone 6. The jaws 9*a* and 9*b* are then moved towards each other to grip an end of a cone 6 extending from the tube 7, and the closed jaws together with the actuator 10 are moved downward to transfer the cone 6 from the tube 7 to a split clamshell holder 16, which includes an opening 18 for receiving the cone 6 upon opening of the jaws 9*a* and 9*b* and release of the cone 6. Split clamshell holder 16 is connected to the turntable 5 of FIG. 1 by an arm 70 so that the loaded holder 16 can be moved away from the cone loading station and an empty one of the holders 16 moved into the cone loading station to receive another cone 6 in response to gripping and vertical transport of the cone by the gripper 9 in response to jaw opening and closing by linear actuator 10 and vertical movement of the gripper 9 driven by motor 20.

After all of the cones 6 in a tube 7 have been transferred to respective split clamshell holders 16 by the sequence of closing of the jaws 9*a* and 9*b*, downward movement of the jaws together with the linear actuator 10, opening of the jaws 9*a* and 9*b* to release the split cone into the opening 18 of the split clamshell holder 16, and return of the gripper 9 to the uppermost position to receive another cone 6, a sensor (not shown) may be used to detect that the tube 7 is empty, causing the chain mechanism to advance the chain 25 in order to position another tube 7 and stack of cones 6 for transfer, one-by-one, to the split clamshell holder 16.

As shown in FIG. 4, which is a cut-away view of the cone loading station 3 of the apparatus of FIG. 1, the chain mechanism for moving brackets 30 and tubes 7 to a position at which the cones 6 can be removed by gripper 9 further includes a chain adjuster 24 with top and bottom adjusters to adjust a vertical position of chain-driving sprocket wheels 30*a* and 32, and a chain slack adjuster 26 for moving one of the sprocket wheels 32 in a horizontal direction to adjust a tension on the chain 25. As illustrated, the tube holding brackets 30 may optionally be attached to the chain 25 by plates 30*b* and tapered to allow for radial movement of the tubes 7 as the chain 25 engages the sprocket wheels 30*b* and 32 upon being driven by the motor 28.

As illustrated in FIGS. 1 and 5, two of the cone loading stations 3 shown in FIGS. 2-4 may be provided to simultaneously transfer cones 6 to openings 18 of respective split clamshell holders 16, and thereby double the cone loading rate. Each cone loading station 3 includes a gripper with jaws 9*a* and 9*b*, a linear actuator 10, a horizontal actuator for moving a respective gripper in a vertical direction, a plurality of tubes 7, and a tube transporting chain mechanism driven by a motor 28. Also shown in FIG. 5 is the turntable 5, which rotates in direction 37 to move the holders 16 to and from the respective cone loading stations 3.

FIG. 6 shows a variation of the embodiment of FIGS. 1-4 with a separate spring-loaded chain tension adjusting mechanism 45 and optical encoder openings or magnetic encoder elements 44 in the sprocket wheels 46. The encoder openings or elements 44 provide positioning feedback to software for controlling chain moving stepper or servo motor 28 to position the chain 25, brackets 30, and cone-holding tubes 7 as they are moved around cone loader bottom plate 49 in the direction indicated by arrow 42.

Figure 7:
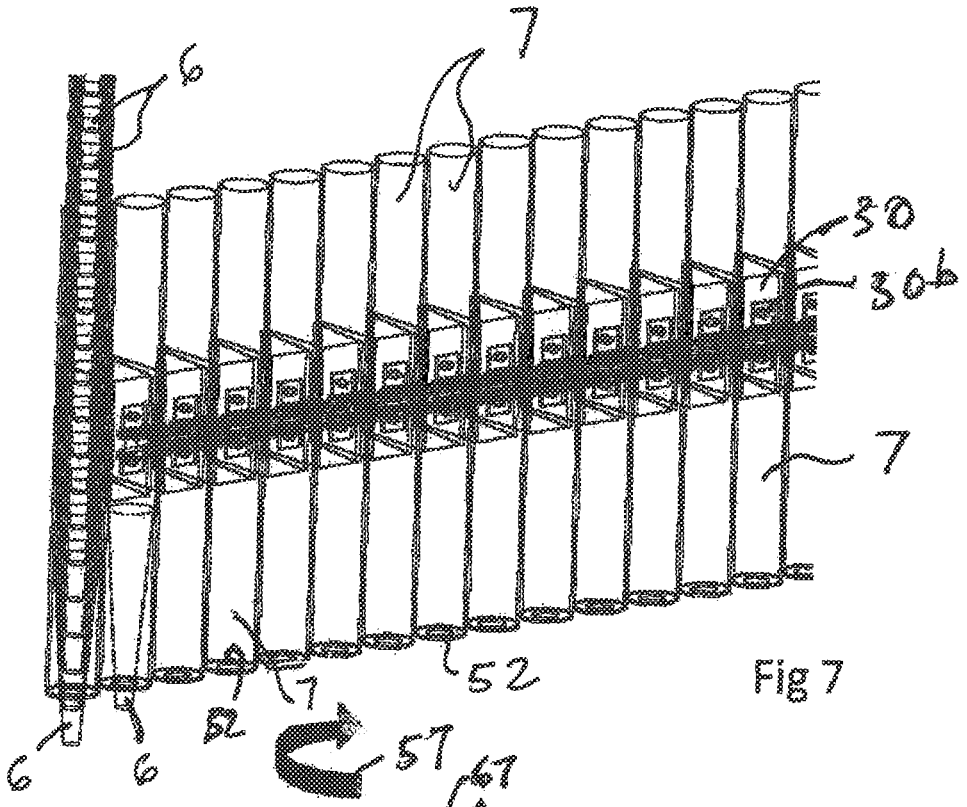
FIG. 7 is a schematic view of the chain and tubes included in the cone stack transporting mechanism of FIG. 2.

FIG. 7 illustrates the manner in which the cones 6 are held in the tubes 7 until pulled out by the gripper 9. The cone holding arrangement includes a washer style bottom plate with a central opening 52 that squeezes the cones as they are pulled out of a respective tube 7, resulting in separation of the lowest cone from its stack to ensure that only a single cone is pulled out at time. Although no additional cone holding devices are included in the illustrated embodiment, it will be appreciated by those skilled in the art that the cone holding and withdrawing arrangement may be assisted by, for example, an additional friction plunger to apply an additional force to ensure separation of respective cones from the stack and removal from the tube 7.

FIGS. 8-13 show various embodiments of the cone twisting station 4 that is used to complete the smokable product after the cone has been filled with precisely measured portions of powdered cannabis dispensed at the weighing and filling stations 1,2 of the apparatus illustrated in FIG. 1.

Cones 6 that have been filled with cannabis powder at the weighing and filling stations 1,2, are transported by the holders 16 to a position at which the tops of the cones 6 can be gripped by a twister device 67 and rotated in the direction indicated by arrow 57 (or in an equivalent reverse direction), the twister device 76 having jaws 91 that open and close in the direction indicated by arrows 59, and move up and down in the direction indicated by arrow 58. In this figure, the filled cones ready for twisting are indicated as element 60. Opening and closing of the jaws 91 is provided by a linkage 92 actuated by a rotating drive shaft motor 84, shown in FIG. 9. The up and down movement of the twister mechanism is provided by a stepper or servo motor 68, with the length of travel being optionally determined by the height of the cone as tracked by a sensor (not shown). The twister device 67 is arranged to twist different cone sizes and to automatically adjust for cone heights in the split clamshell holder 16.

As illustrated in FIGS. 9-14, the rotating twister mechanism 67 has three sets of jaws 91, which are positioned 120 degrees apart to grab and twist the top end of a cone 6 positioned in the split clamshell holder 16 while a pin ball friction device prevents rotation of the cone in the holder 16. The pin ball friction device includes a stationary friction block 64 fixed to holder transport arm 70. Stationary friction block 64 engages a pin ball 63 to drive a spring loaded pin 62 into an opening (not shown) in jaw 16*b* and engage the cone 6. Engagement of the spring loaded pin 62 with the cone 6 adds additional friction to prevent the cone 6 from rotating as the twister jaws 91 close on and twist the end of the cone. The same spring loaded pin 62 can be used to dislodge the cone from the holder to ensure that the cone is removed when it moves to the discharge station. An adjustment block 66 may be arranged to engage support 63*a* mounted on stationary arm 69 and cause jaws 16*a* and 16*b* of holder 16 to move in a direction of providing additional friction on the cone to prevent it from rotating. In addition, adjustment block 66 may also include a plurality of threaded openings for receiving screw 65 attached to the ball 63, enabling adjustment of the relative position of ball 63, and in turn control the timing and amount of pressure applied to the cone by spring-loaded pin 62.

Figure 8:
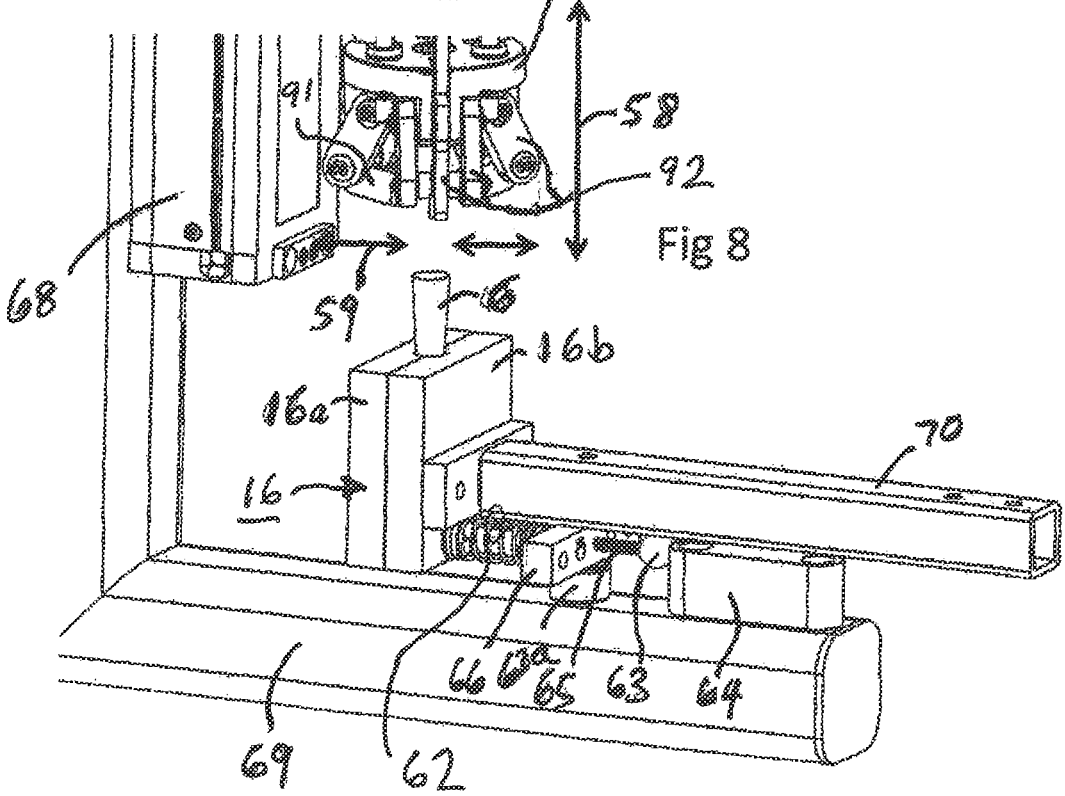
FIG. 8 is an isometric view of a cone twisting mechanism for use in the apparatus of FIG. 1.
Figure 9:
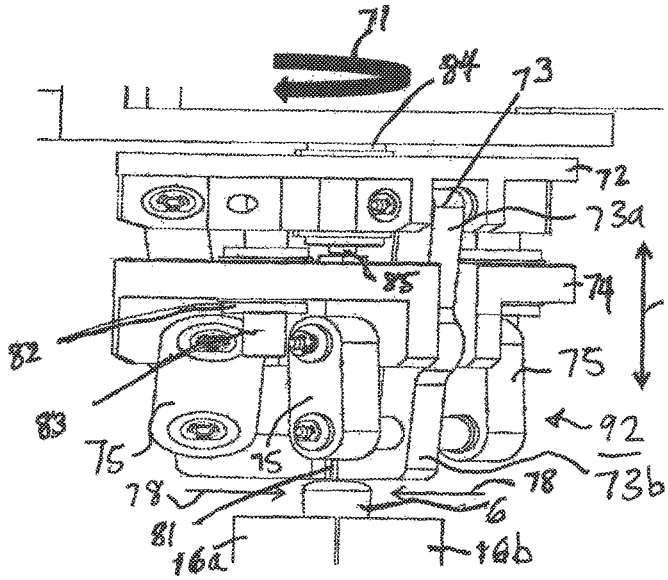
FIG. 9 is an isometric view showing the cone twisting mechanism of FIG. 8 during twisting.
Figure 11:
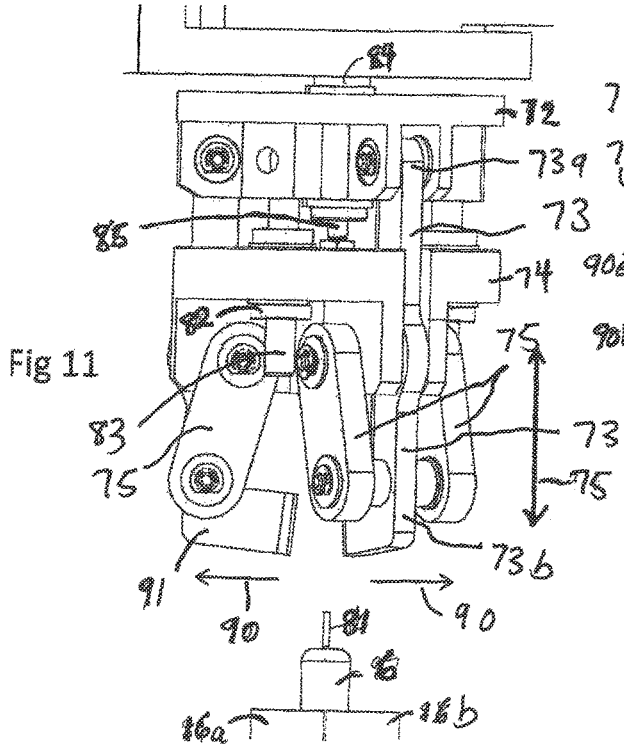
FIG. 11 is an isometric view of the cone twisting mechanism of FIGS. 8 and 9 following release of a twisted cone.
Figure 10:
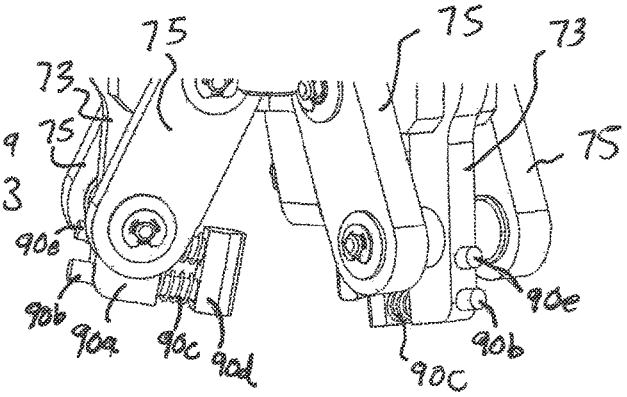
FIG. 10 is an isometric view showing a variation of the twisting mechanism of FIGS. 8 and 9 that includes spring-loaded grippers.

As shown in FIGS. 9-11, the linkage 92 illustrated in FIG. 8 includes the three jaws 91, which extend from three vertical connecting shafts 73. Vertically connecting shafts 73 are pivotally coupled at first ends 73*a* to a first base plate 72, and pivotally coupled at second ends 73*b* to respective pairs of crank arms 75. Crank arms 75 are in turn pivotally coupled between the vertical connecting shafts 73 and a linearly movable second base plate 74 to form a crank-type linkage that causes the three jaws 91 to open and close as the linearly movable second base plate 74 is moved axially relative to the first base plate 72. Axially movement of the second base plate 74 relative to the first base plate 72 is carried out by a shaft 85 connected to a linear actuator or motor 137, shown in FIG. 16. Shaft 85 extends through a hollow rotation shaft 84 connected to a motor 135, also shown in FIG. 16, and to the base plate 72 to rotate both the first base plate 72 and, through a driving pin 83 and bearing 82, the linearly movable second base plate 74, thereby allow opening and closing of the jaws and rotation of the twisting mechanism to be independently controlled.

The cone twister of FIG. 8 thus operates as follows: In the position shown in FIG. 9, the three jaws 91 of the twister have closed at the same time to apply friction to the cone 6 being held by the split clamshell holder 16 with the assistance of the friction pin 62. Arrow 78 in FIG. 9 indicates the jaw closing direction, and reference numeral 81 indicates a section 81 of the cone 6 that is being held and twisted by the closed jaws, which are rotated in the direction of arrow 71 in response by motor 84 via first base plate 72, driving pin 83, bearing 82, and second base plate 74. As shown in FIG. 11, after rotation by a predetermined amount or an amount determined by a servo, slip clutch, and/or friction clutch, as will be described below, the second base plate 74 is moved away from the first base plate 72 in order to cause the linkage mechanism 92 to open the jaws in the direction indicated by arrows 90 and release twisted cone section 81, completing the twisting process, at which time the twisting mechanism is rotated to a home position and the holder 16 can be moved away from the twisting station 4, also causing release of the pin ball friction device. The home position of the twisting mechanism may be established, for example, by a limit switch (not shown)

Optionally, as shown in FIG. 10, the jaws of the twister mechanism may be spring-loaded and the material of the contact surfaces selected to control friction between the jaws and the twisted end of the cone. As illustrated in FIG. 10, the integral jaws 91 of FIG. 8 are replaced by jaw assemblies that include springs 90*c* in the form of compression coil springs configured to extend around dual shafts 90*b* and 90*e*, on which gripper fingers 90*b* are slidably mounted to move relative to a base 90*a*, formed by a modified lower end of one of the vertical connecting shafts 73 shown in FIG. 8. The springs 90*c* bias the gripper fingers 90*b* away from the bases 90*a* to exert pressure on the cone. It will be appreciated that the gripper fingers 90*b* may be made of rubber, plastic, metal, a composite material, urethane or any other appropriate material. The shaft side linear bearings are not shown in FIG. 10.

Figure 12:
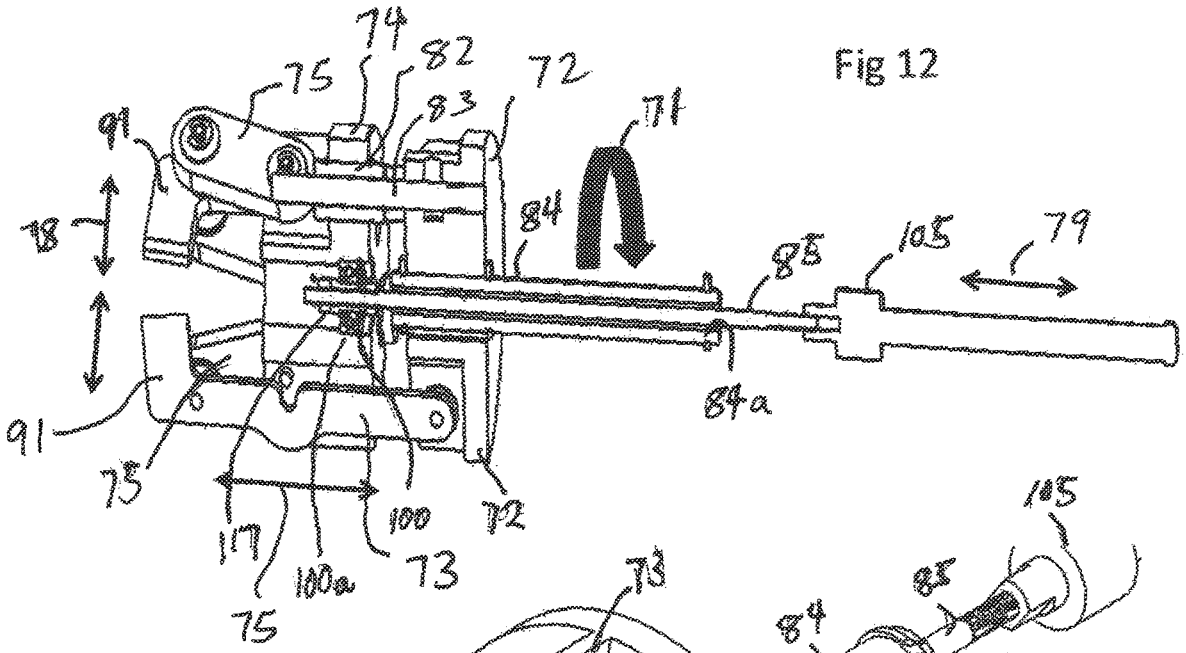
FIG. 12 is a cross-sectional view showing details of an opening and closing arrangement for the cone twisting mechanism of FIG. 8.
Figure 13:
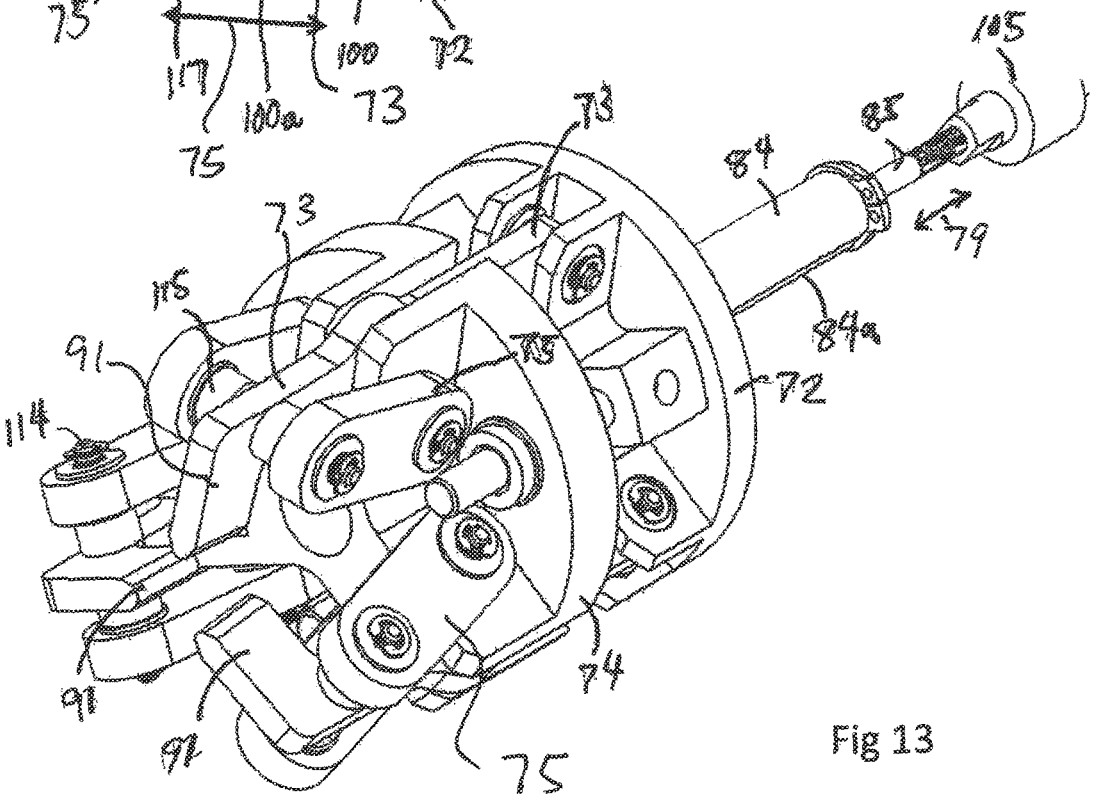
FIGS. 13 and 14 are isometric views showing opening and closing operation of the opening and closing arrangement of FIG. 12.
Figure 14:
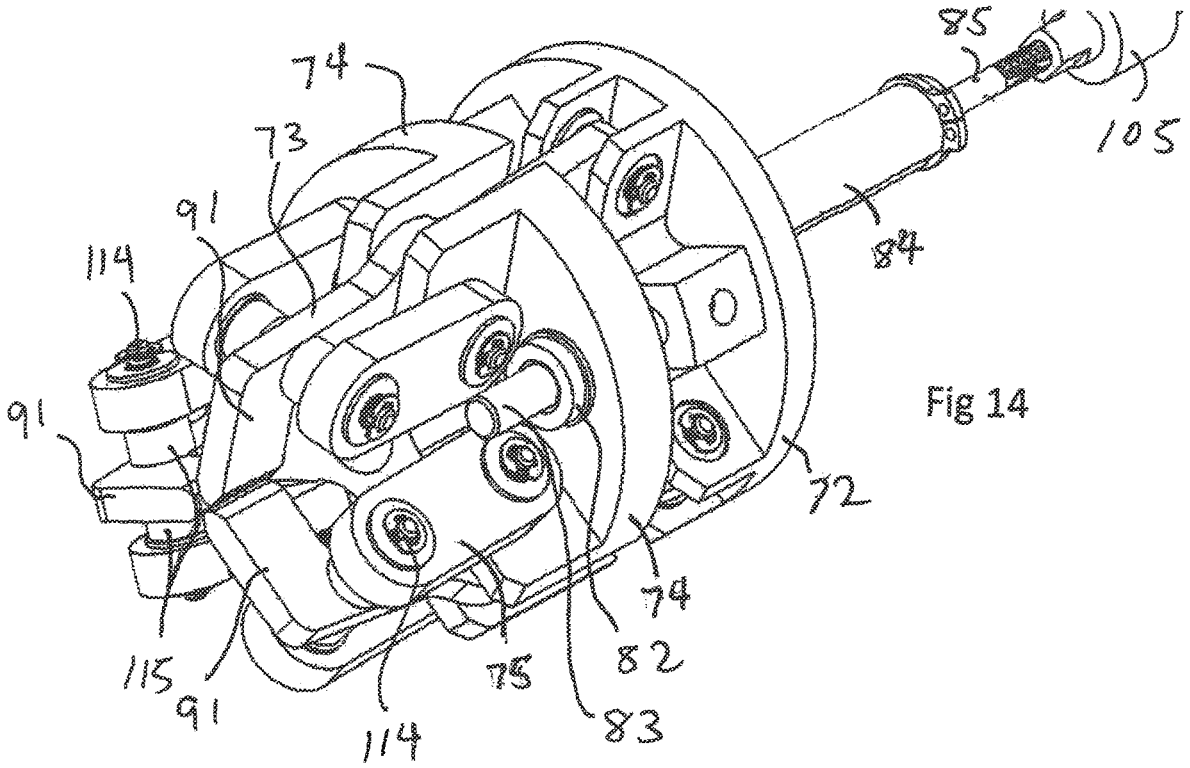

FIGS. 12-14 further illustrate the arrangement for linearly movable second base plate 74 relative to first base plate 72 in order cause opening and closing of the twister jaws, as described above in connection with FIGS. 9 and 11. Reference numeral 84 again indicates the hollow shaft of the motor that rotates the first base plate 72 in the direction of arrow 71 while reference numeral 83 indicates the shaft that causes linearly movable second base plate 74 to move in direction 79 relative to base plate 72 and cause opening and closing of the jaws 91 via a linkage mechanism such as the one described above in connection with FIG. 8. Shaft 85 is fixed to the base plate 74 by a connector 117 in order to enable the linear movement of plate 74, while a bearing 100 having a bearing housing 100*a* that cooperates with connector 117 to allow rotation of the base plate 74 relative to the shaft 85, as described above, so that the jaws 91 can open and close while the twisting mechanism rotates.

Figure 15:
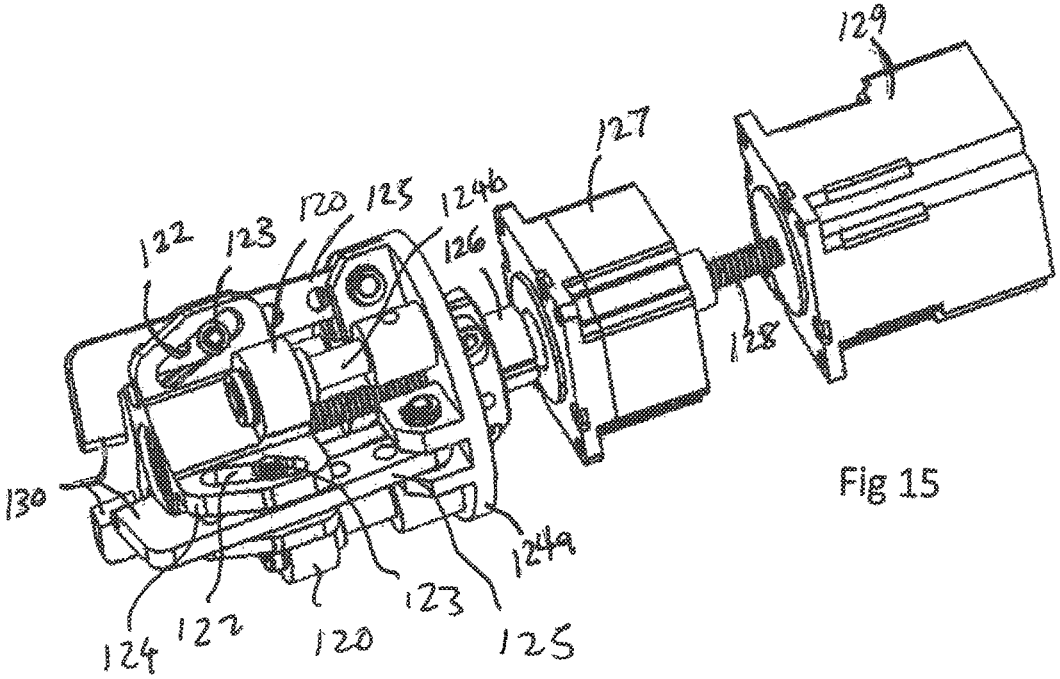
FIGS. 15 and 16 are isometric views showing operation of an alternative to the cone twisting mechanism of FIGS. 8-14.

As shown in FIGS. 12-14, shaft 85 passes through an interior surface 84*a* of hollow shaft 84, and is further connected by a shaft 105 to a linear actuator (such as motor 129 shown in FIG. 15). FIG. 13 (depicting the jaws 91 in an open position) and 14 (depicting the jaws 91 in a closed position) also show a keyway 84*a* of the rotating hollow shaft 84, and pivot shafts 114 and ball bearing 115 to provide low friction pivoting couplings for the linkage in order to ensure high cycle times. Although specific couplings are shown, however, it will be appreciated that both the couplings and the specific configuration of the base plates and linkage may be modified without departing from the scope of the invention, so long as the base plates and linkage are capable of rotating as well as opening and closing the jaws of the twisting mechanism.

Figure 16:
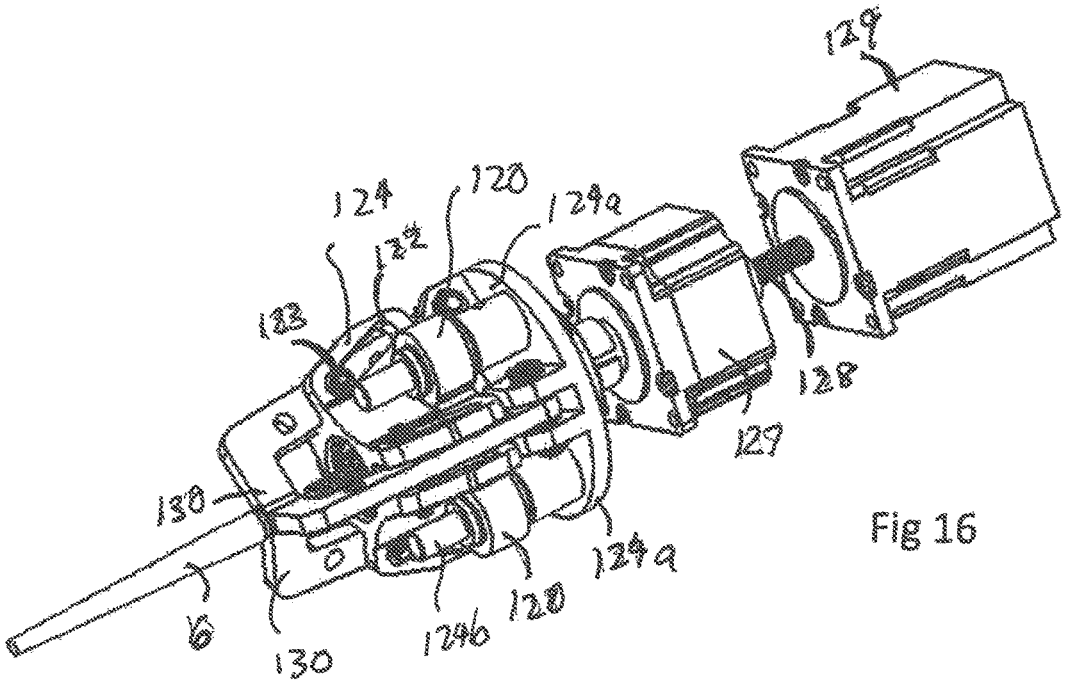
Figure 17:
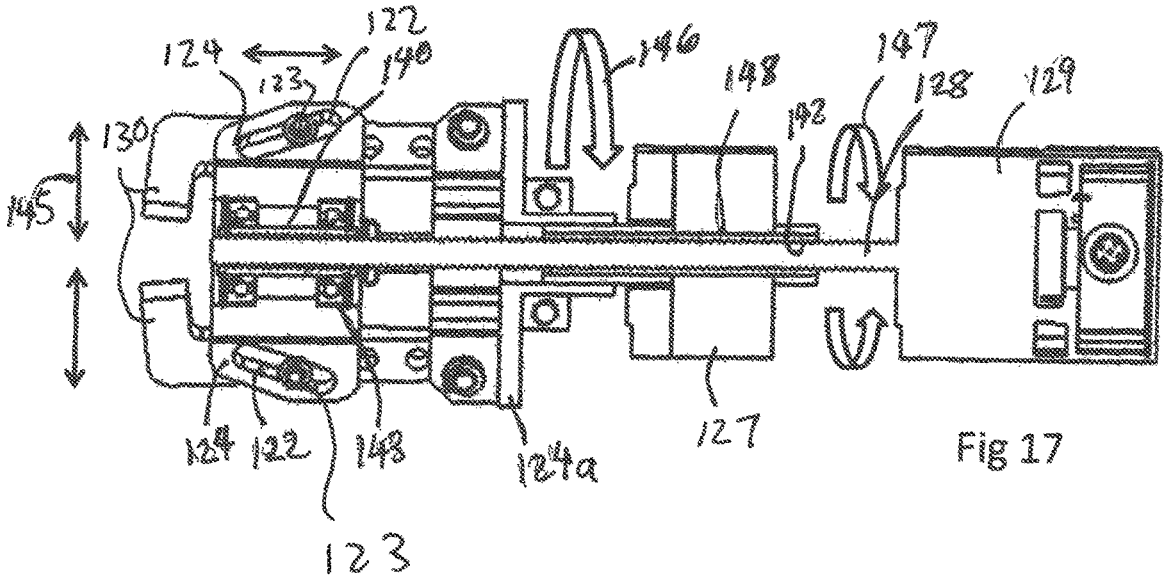
FIG. 17 is a cross-sectional view of the cone twisting mechanism of FIGS. 15 and 16.

FIGS. 15-17 show an alternative to the twister mechanism of FIGS. 8-14, in which the pivotal link mechanism is replaced by a threaded rod and follower mechanism for opening and closing the jaws 130. As shown in FIGS. 15-17, the twister mechanism is rotated by a hollow shaft motor 127 that rotates plate 124*a* via hollow shaft 126, while opening and closing of the jaws is controlled by a second motor 129 and threaded shaft 128, onto which is threaded a follower in the form of a hub assembly 124 that moves linearly as the shaft 128 is rotated. The hub assembly 124 includes slots 122 that guide cam bearings 123 extending from rear connecting arms 125 to pivot in a radial direction and thereby open and close the jaws 130 as the screw is rotated in respective clockwise and counterclockwise directions.

FIGS. 15 and 17 show an open position of the jaws 130 and FIG. 16 shows the closed position, in which the jaws 130 have gripped an end of the cone 6 for twisting, and in which the journal bearing 123 has moved from the upper end shown in FIG. 15 to a lower end of the slot 122. The twisting motion provided by motor 127 is indicated in FIG. 17 by arrow 146, while rotational motion of the threaded shaft 128 is indicated by arrow 147, the rotational motion resulting in linear movement of the hub assembly and, as a result of the motion-converting cam slots 122, opening and closing movement of the jaws in the direction of arrows 145. Rotational coupling between the slotted hub assembly and the rotating plate 124*a* may be provided by bearings 120 rotatably mounted on pines 124*b* that extend from plate 124*a*, and by bearing 143 between the hub 124 and threaded follower 140 for converting rotation of the threaded shaft 128 into linear motion of the hub 124. As in the embodiment of FIGS. 8-14, both motors 127 and 129 can operate independently and simultaneously to optimize timing of jaw opening and closing and twisting of the cone when the jaws are closed. Motor 127 includes a passage 148 to allow to allow rotation of the screw shaft 128 without coupling between the screw threads 142 and the surface of the passage 148.

Figure 18:
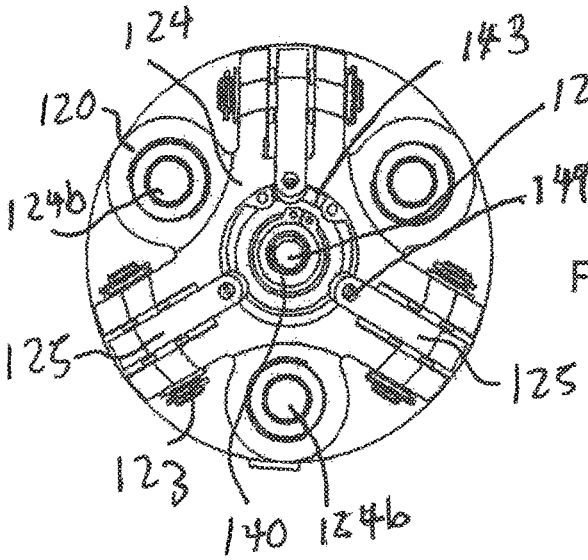
FIG. 18 is an end view of a variation of the gripper jaws used in the cone twisting mechanism of FIGS. 15-17.

FIG. 18 shows a variation of the twister assembly of FIGS. 15-17, in which the jaws 130 are replaced by friction pads (not shown) mounted via fastener holes 149 to allow the cone gripping surface to be varied, and/or to allow replacement of the pads as necessary. FIG. 18 also provides an end view of the bearings 120, rotation-transmitting pins 124*b*, cam follower 140 and threaded shaft 128 assembly that enables rotation of the twister assembly while also permitting linear motion to open and close the jaws, as described above.

Figure 19:
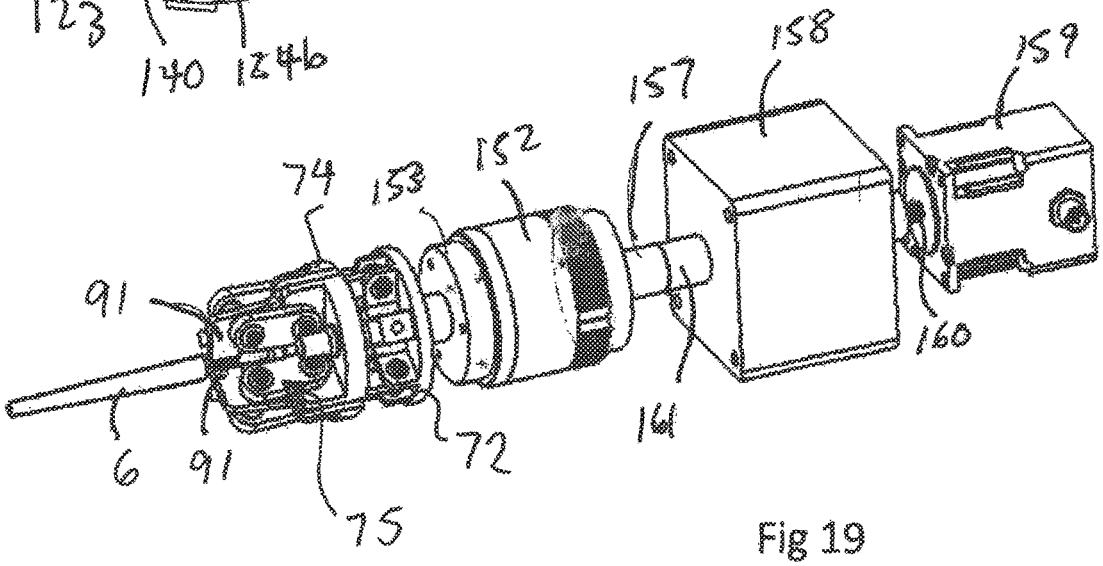
FIG. 19 is an isometric view showing a further variation of the cone twisting mechanism of FIGS. 15-17.

FIG. 19 shows a variation of the twister assembly that may be applied to any of the twister mechanisms illustrated in FIGS. 8-18, although the specific embodiment shown is that of FIGS. 9-14. The variation is that an adjustable magnetic slip clutch 152,153 is added between the rotary twisting motor 152 and the rotating base plate 72 (or 124*a*). Slip clutch 152,153 limits the torque applied to the paper cone during twisting so that the paper does not tear. The torque limit can be manually set by an operator or controlled by, for example, software using pulse width or pulse duration modulation, or a variable direct current voltage on an electromagnetic coil of the slip clutch.

Figure 20:
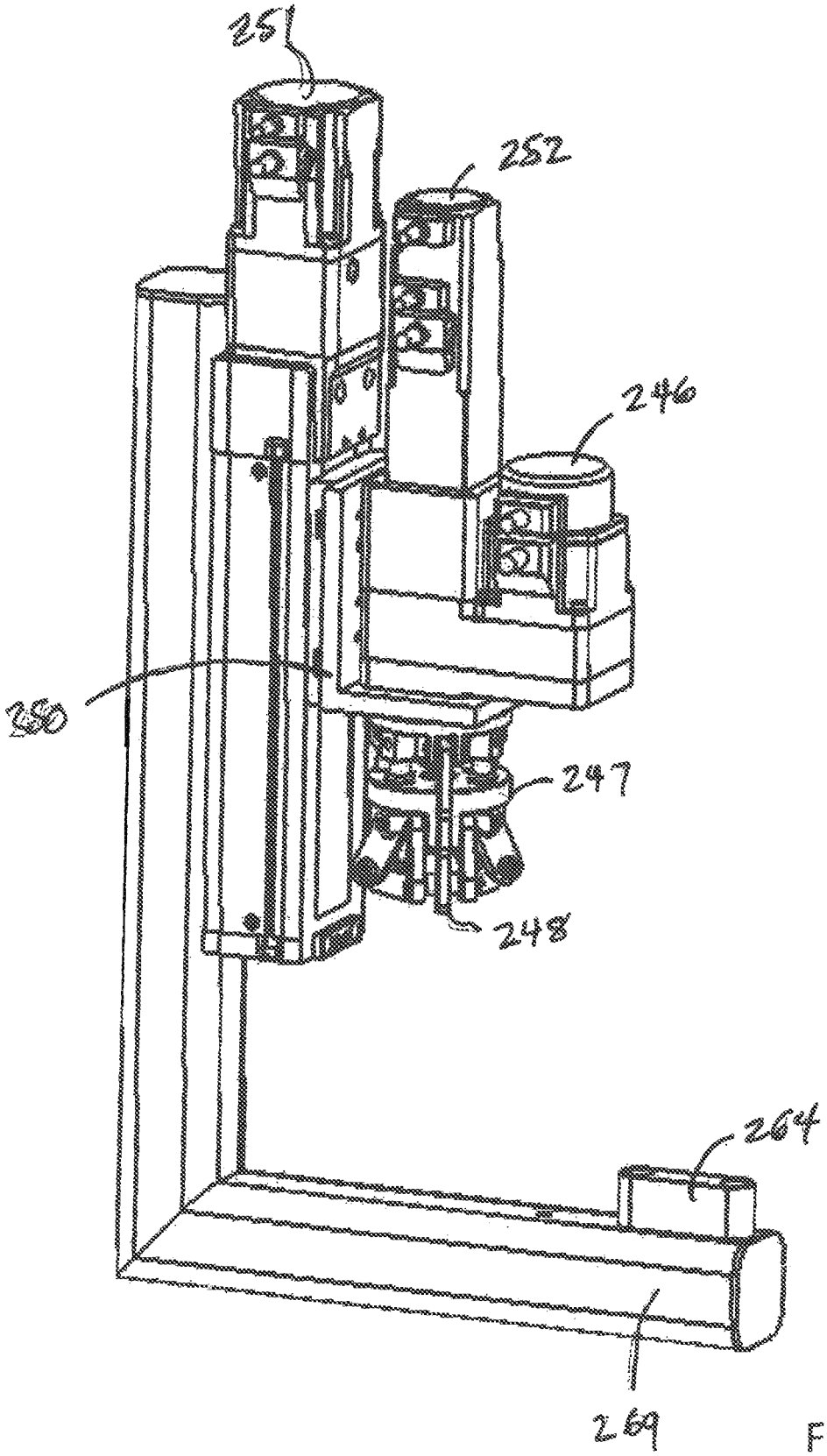
FIG. 20 is an isometric view of a complete cone twisting mechanism corresponding to the twister mechanism illustrated in FIG. 8.

As shown in FIG. 20, the cone twisting station may be configured such that the rotational motor 246 for rotating the twister mechanism 247 through an appropriate gear train or transmission (not shown) is positioned adjacent the linear actuator 252 for opening and closing the twister jaws, indicated by reference numeral 248. Twister mechanism 247 and jaws 248 can correspond to any of the twister mechanisms and jaws illustrated in FIGS. 8-19. In addition, FIG. 20 shows a second linear actuator 251 for moving a twister mechanism support 248 towards and away from the cone and holder. Finally, FIG. 20 also shows stationary friction block 64 and arm 69 of FIG. 8, which can be used in any of the examples of FIGS. 8-19.

Figure 21:
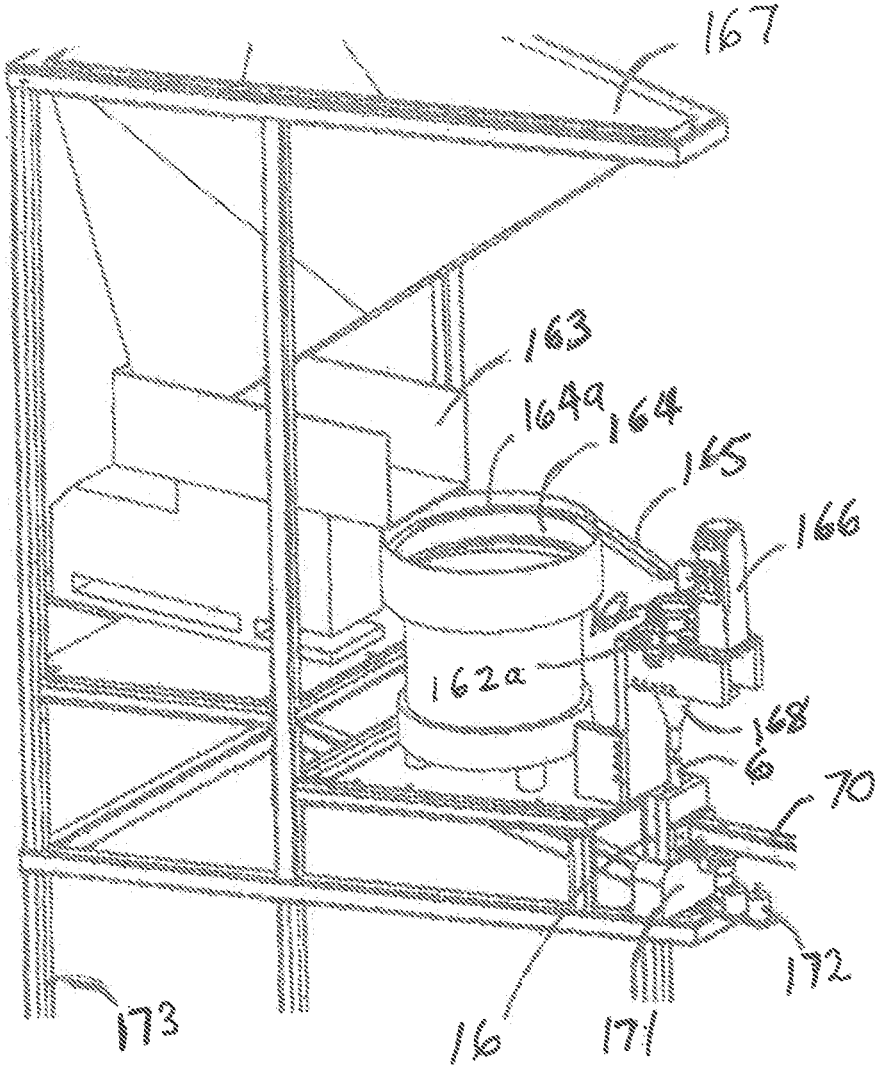
FIG. 21 is an isometric view of a cannabis powder cone filling station for use in the apparatus of FIG. 1.

FIGS. 21-25 illustrate a first embodiment of the weighing and filling stations 1,2 illustrated in FIG. 1. As shown in FIG. 21, the weighing and filling station is supported by a frame 173 and includes sensors 172 for detecting the presence of a cone-containing clamshell holder 16, and a storage hopper 167 hat stores a large quantity of powdered biomass to be dispensed in precisely weighed quantities into cones 6 that have been transported via the split clamshell holders 16 from the cone loading station or stations 3. Storage hopper 167 has an open bottom that allows biomass to fall onto a tray 163 and actuator 163*a* arranged to vibrate continuously so as to transfer a proportional amount of powdered biomass into a rotary feed hopper 164. When rotary feed hopper 164 is rotated, powdered biomass at the bottom of the hopper is transferred by centrifugal force up a spiral groove 164*a* to a feeder 165. Feeder 165, which is illustrated as a chute but could take the form of an auger or vibrating feeder extending into the rotary feed hopper 164 (in place of the groove 164*a*), deposits the powdered biomass into a cup 162 for weighing by load cell 162*a* and dispensing into the cone 6 via a funnel 168 movable up and down in the direction of arrow 174 by means of a linear motor 166.

Figure 22:
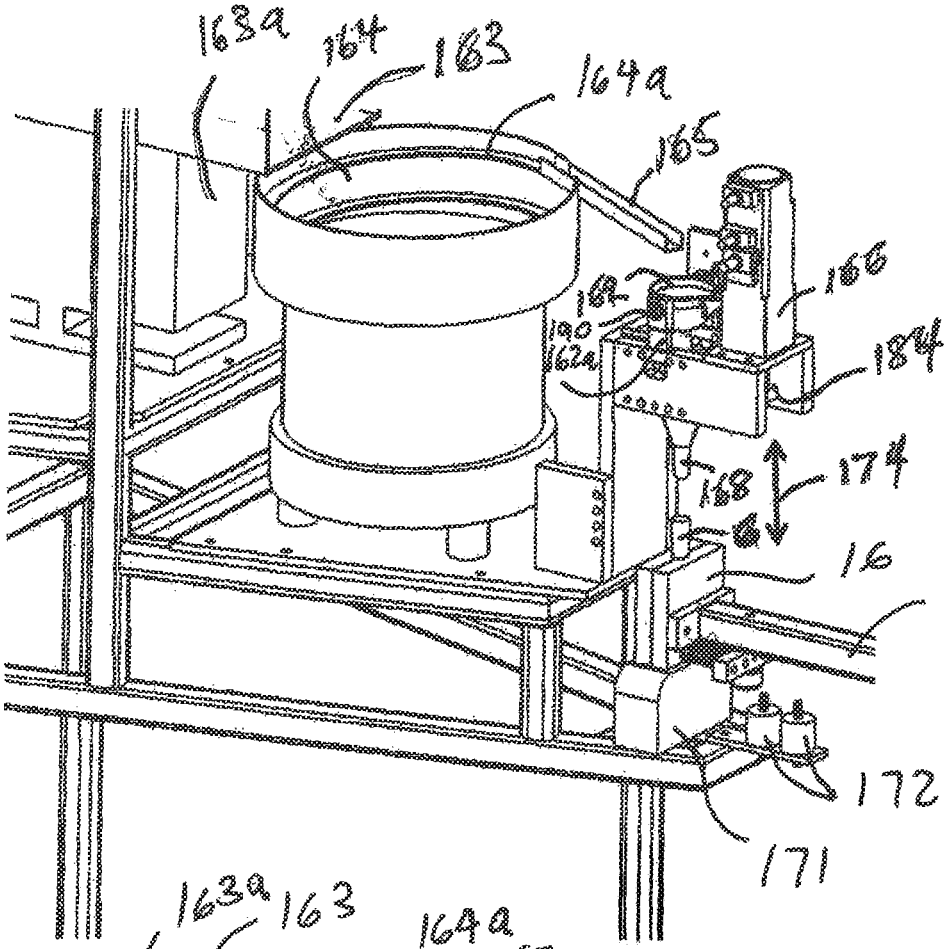
FIGS. 22 and 23 are isometric views respectively showing a weighing position and a cone filling position of a cannabis powder weighing and cone filling mechanism for the cone filling station of FIG. 21.
Figure 23:
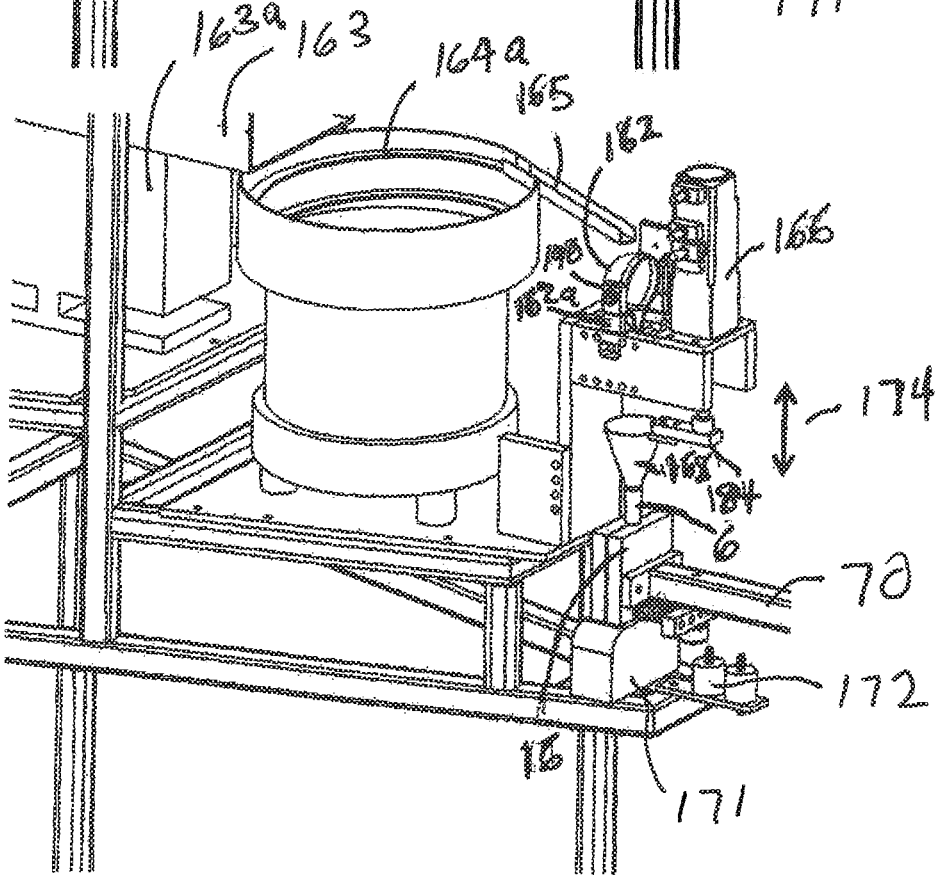
Figure 24:
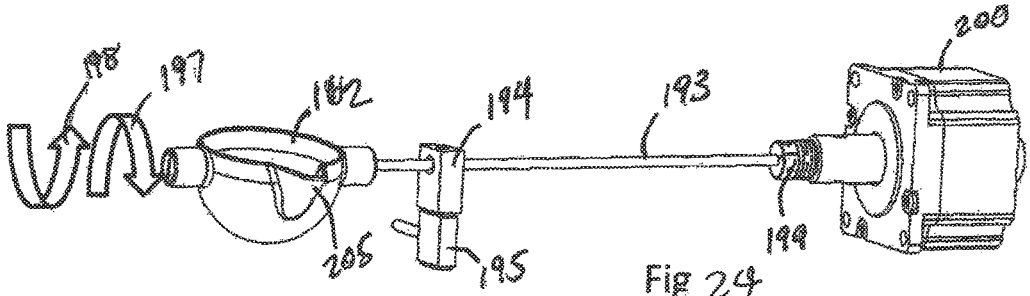
FIG. 24 is an isometric view showing details of the weighing and cone filling mechanism illustrated in FIGS. 22 and 23.
Figure 25:
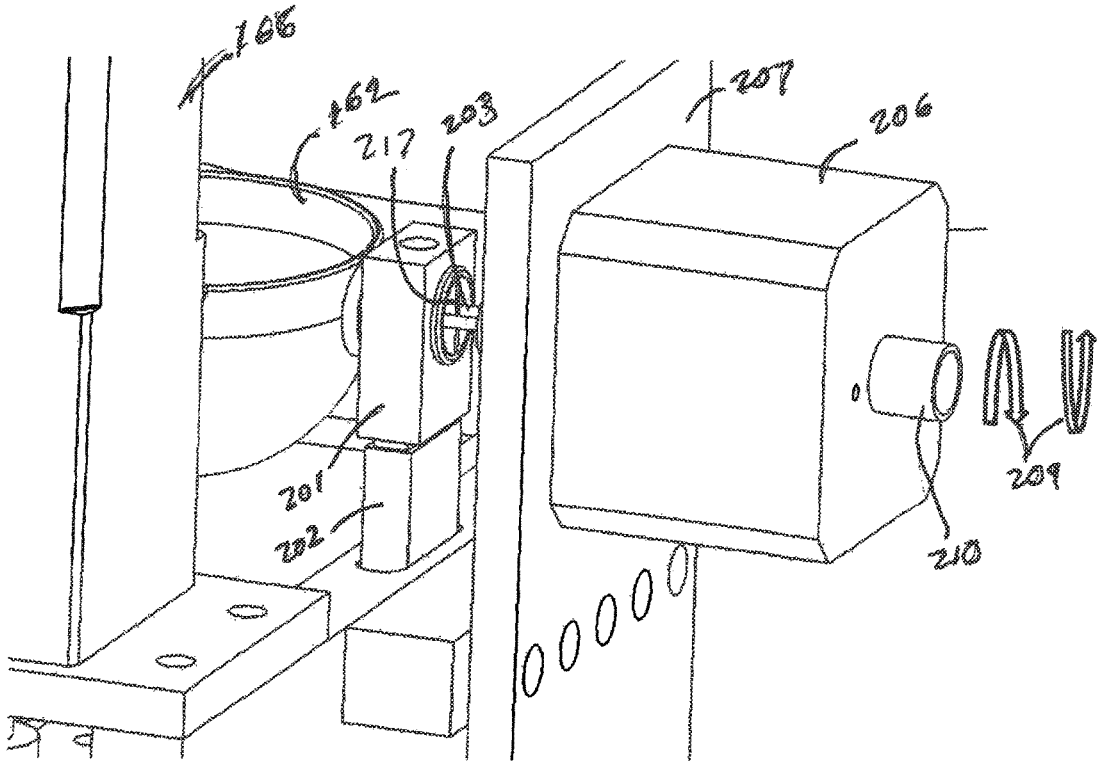
FIG. 25 is an isometric view showing a variation of the weighing and cone filling mechanism illustrated in FIG. 24.

When a predetermined amount of powder has been transferred to the cup 162, a linear motor 166 is activated to move the funnel 168 downward so that an end of the funnel 168 enters the cone, and a rotary stepper or servo motor 200 or 206, shown respectively in FIGS. 24 and 25, is activated to tilt the cup and dump the powdered biomass, i.e., to discharge the contents of the cup 162 by gravity through the funnel 168 and into the cone 6 being held by the above-described split clamshell holder 16. The split clamshell holder 16 may be vibrated by a vibrator 171 to shake the powder biomass in the cone 6 in order to ensure that it settles into the cone 6 in preparation for twisting at the twisting station 4 described above in connection with FIGS. 8-20, while the funnel 168 moves upwardly into its home position and the cup 162 is positioned to receive more biomass. As illustrated in FIGS. 22 and 23, the cup 162 may be attached to the load cell 162*a* by bearings 190 through which the weight is sensed, and the linear motor 166 may be attached to the funnel 168 by a bracket 184, best shown in FIG. 23.

Those skilled in the art will appreciate that the reason for having the tip of funnel 168 actually enter the cone 6 to prevent escape or spillage of the powdered biomass during transfer from the cup 162 to the cone 6. In addition, the reason for the use of separate motors to tilt or rotate the cup and to move the funnel up and down is to isolate the cup 162 for accurate weighing.

FIGS. 24 and 25 show to alternative ways of supporting cup 162 in order to accurate weigh its contents before tilting to dispense the contents into the funnel 168. In the embodiment illustrated in FIG. 24, the weight-sensing bearings 190 are replaced by a bearing 194. In order to ensure an accurate weight, the cup 162 is pivoted by a cantilevered extension shaft 193 that passes through the bearing 194 but is otherwise unsupported so that the entire weight of the cup 162 is borne by the bearing 194. The weight of the cup is thereby transmitted through bearing 194 to load cell 195, which continuous weighs the contents of cup 162 and its contents and generating a signal when the desired content weight is in the cup. This signal is sent to the motor 200, which rotates the shaft 193 to dump the contents of the cup into the funnel 168, and is also sent to the hopper 164 to stop rotation of the hopper until after the contents of the cup have been transferred to the funnel 168 and the cup 162 is ready to receive more powdered biomass from the hopper 164. In this embodiment, reference numeral 199 indicates a flexible shaft coupler that allows rotation of the shaft 193 by the motor 200. Also shown in FIG. 23 is a spout included in the cup 162 to assist in spillage prevention during pouring of the powdered biomass into the funnel 168 when the cup 162 is tilted.

FIG. 25 shows an alternative load cell arrangement that utilizes a two-prong shaft coupler 201 having a planar divider 212 fixedly connected with the cup 162, and a motor 206 mounted on bracket 207 and having a shaft 210. Prongs 203 extend from the shaft 210 and through the coupler 201 without contacting the cup 162. When it is time to tilt the cup 162 and pour the contents into funnel 168, the two prongs 203 are rotated, which causes them to engage planar divider 212 of the coupler 201. Before rotation, the entire weight of the cup and its contents are borne by the shaft coupler 201 without being affected by a motor coupling, and therefore can be accurately measured by the load cell 202, which is coupled to the shaft coupler 201. Optionally, the cup 162 may rest on two load cells located on opposite sides of the cup to cancel out vibrations from external sources that might affect the weight measurement.

FIGS. 26-34 show an alternative to the weighing and cone filling station illustrated in FIGS. 21-25, in which a continuously operating, variable speed water wheel type mechanism is used to weigh the powdered cannabis material and dispense it into cones.

Figure 26:
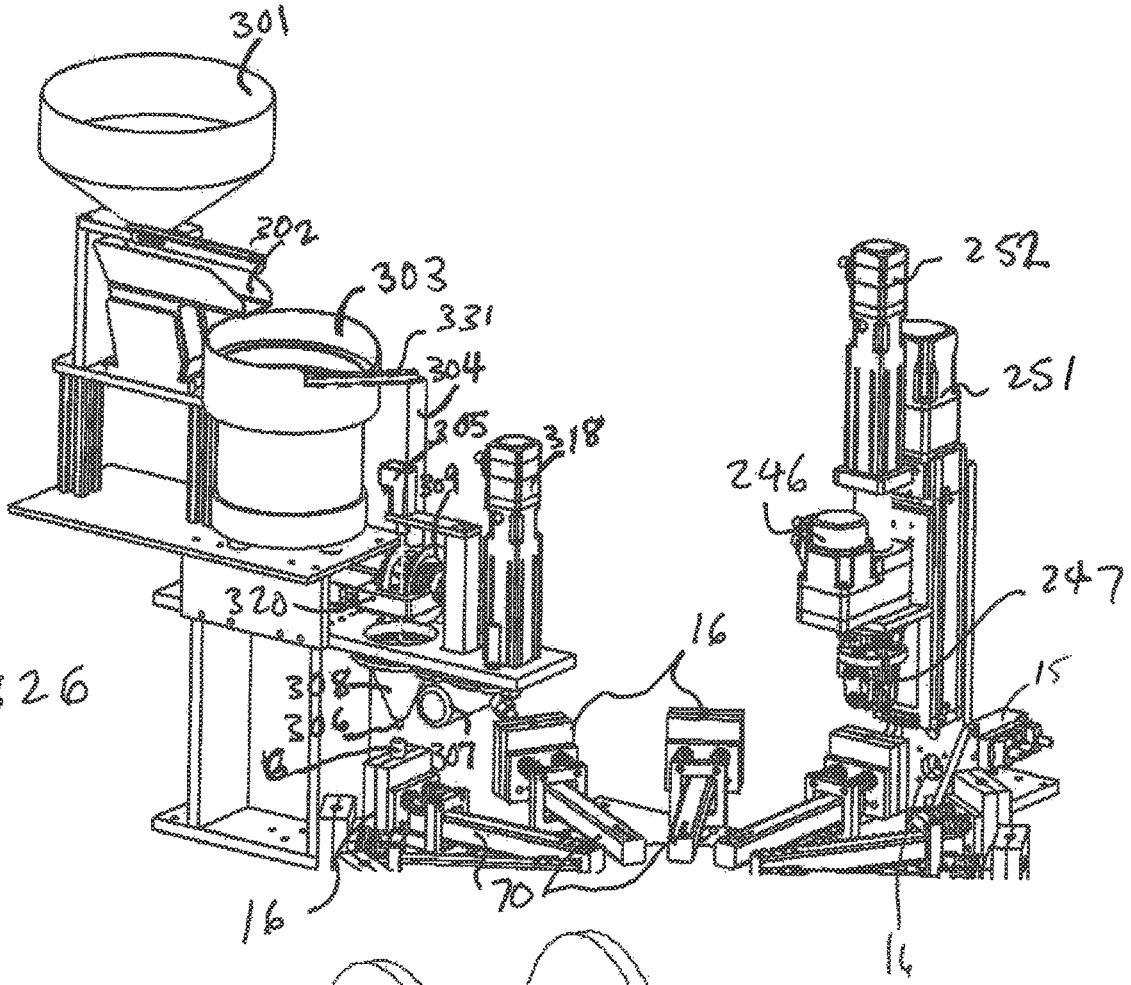
FIG. 26 is an isometric view showing a further variation of the weighing and cone filling mechanism of FIGS. 21-25, in which weighing and weighed-powder dispensing are carried out simultaneously by a wheel mechanism.

As illustrated in FIG. 26, the alternative weighing and cone filing station includes a hopper 301 that feeds the powdered biomass to a vibratory trough 302, and from there to a rotary feed hopper 303 and exit chute 331 similar to the rotary feed hopper 164 and chute 165 described above in connection with FIG. 21. The output of rotary feed hopper 164 enters a vertical feed tube 304 that feeds a variable speed, rotating weighing wheel 309 coupled to a load cell arm 320 and driven by a wheel motor 323, as shown in FIGS. 28, 29, 33, and 34. A funnel 308 is positioned below the rotating weighing wheel 309 to receive powdered biomass that has been weighed and continuously dispensed by the rotating wheel. A motor 305 turns an auger 306 supported by a mounting plate 317 and that spins in the center of the funnel 308 in order to impart a rotational motion to the falling powdered biomass, indicated by arrow 330 in FIG. 29, in order to add compression to the biomass as it passes through the funnel 308 and into the cone 6. Preferably, the direction of rotation 330 corresponds to the natural Coriolis force rotating direction to aid in packing and clog prevention.

Figure 29:
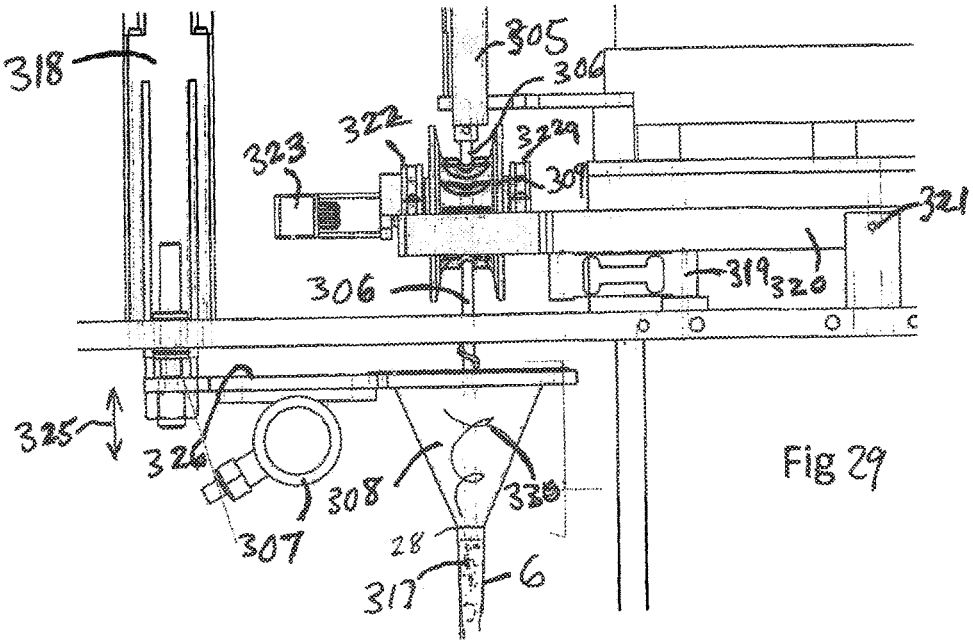

The funnel 308 is mounted to a bracket 326 coupled to a vibrator 307 that causes the funnel 308 to vibrate in an up and down direction indicated by arrow 325 so that, as cones 6 are moved into position between below the funnel 308 and the funnel 308 is lowered into the cone 6 by linear actuator 318, the funnel 308 vibrates in response to vibrator 307 to ensure clog-free passage of the precise dose of powdered biomass, after which the funnel 308 is withdrawn from the filled cone to enable another cone 6 to be moved into position between the funnel. The interface between the cone 6 and funnel 308 in the dispensing position is indicated in FIG. 29 by reference number 328 while, in the illustrated example, oscillator 307 is driven to move up and down by a linear motor 318.

Figure 27:
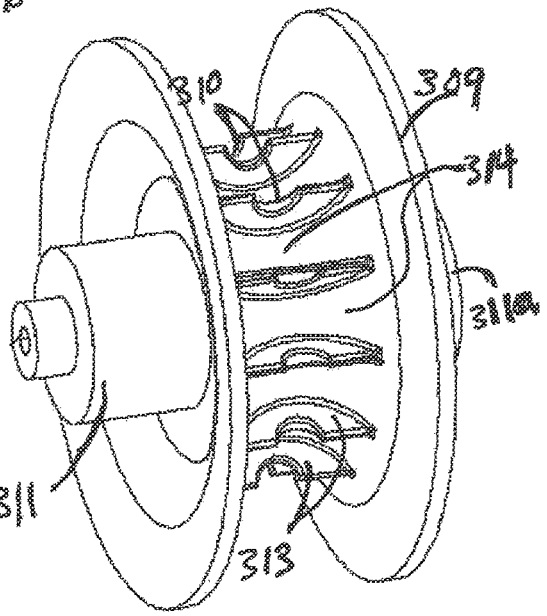
FIG. 27 is an isometric view of the powder weighing and dispensing wheel of FIG. 26.
Figure 28:
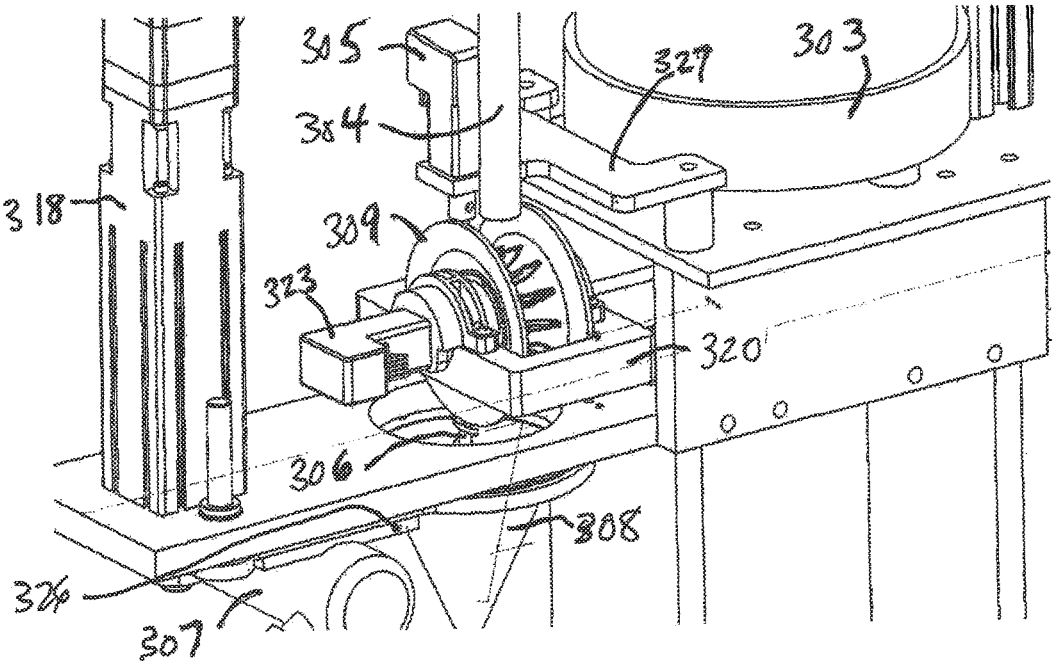
FIGS. 28 and 29 are respective isometric and side views showing details of the powder weighing and dispensing mechanism of FIG. 26.

The combination of a continuous feed rotating weighing wheel 309, rotation-imparting auger 306, and vibrating funnel 308 causes the powdered biomass to be filled under pressure and without clogging to ensure that weighing and filling of the cones is carried out with optimal efficiency. As shown in FIG. 27, the rotating weighing wheel 309 is supported on load cell arm 320 by bearings 311 and 311*a*, and includes chambers 314 separated by cavity walls 313. A groove 310 in the cavity walls 313 enables passage of the auger shaft 306, as shown in FIG. 29. As powdered biomass enters one of the chambers 314 from the tube 304 and leaves another chamber 314 to enter the funnel 308, any change in the weight of the wheel 309 is detected by load cell arm 320. The amount of powered biomass supplied to the wheel 309 from the hopper 303 and the rotation speed of wheel are continuously adjusted based on the detected weight change to maintain a constant flow of biomass from the wheel 309 to the funnel 308, thereby enabling a precise amount of powdered biomass to be dispensed to each individual cone 306 through the funnel 308. As illustrated in FIG. 29, the continuous weighing of the wheel 309 is carried out by the load cell 319 via cell arm 320, which rests on load cell 319, is supported at one end by pivot bearing 321, and is fixed at the other end to bearing housings 322 and 322*a*. Bearing housings 322 and 322*a* support the wheel bearings 311 and 311*a* shown in FIG. 27, and therefore transfer the weight of the wheel 309 to the load arm 320.

Figure 30:
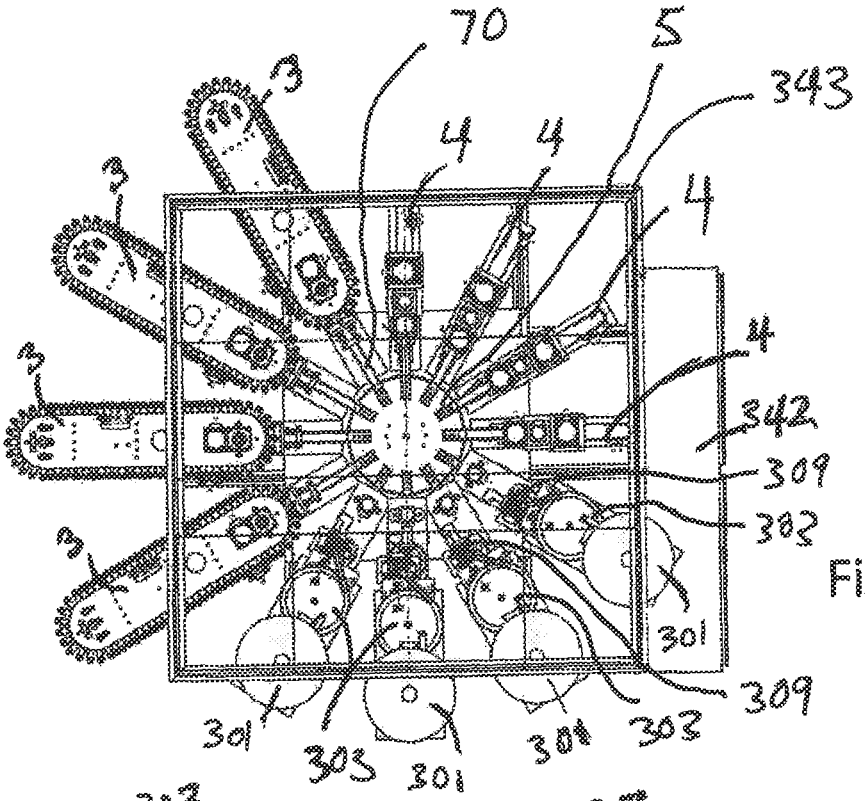
FIG. 30 is a top view showing an arrangement in which a plurality of powder weighing and cone loading stations of the type shown in FIGS. 26-29 are positioned with respect to a corresponding number of cone loading and cone twisting stations for synchronized parallel operation.
Figure 31:
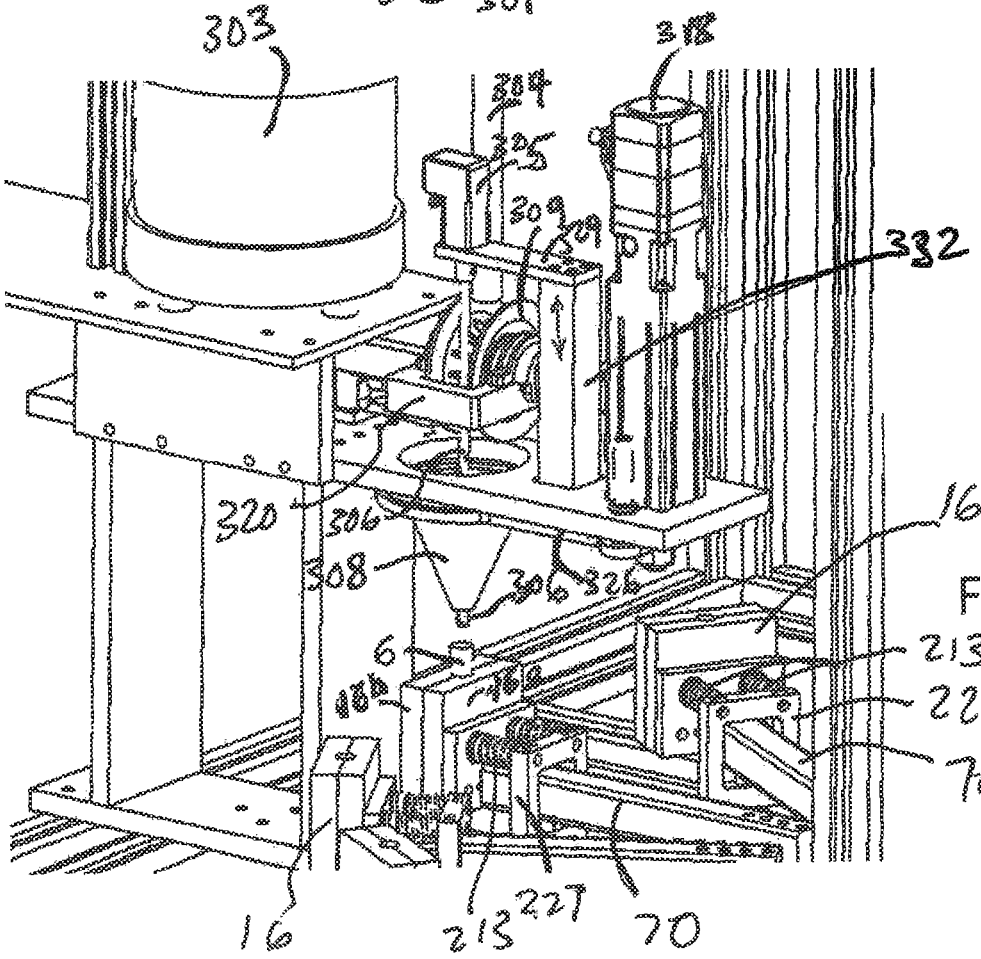
Figure 32:
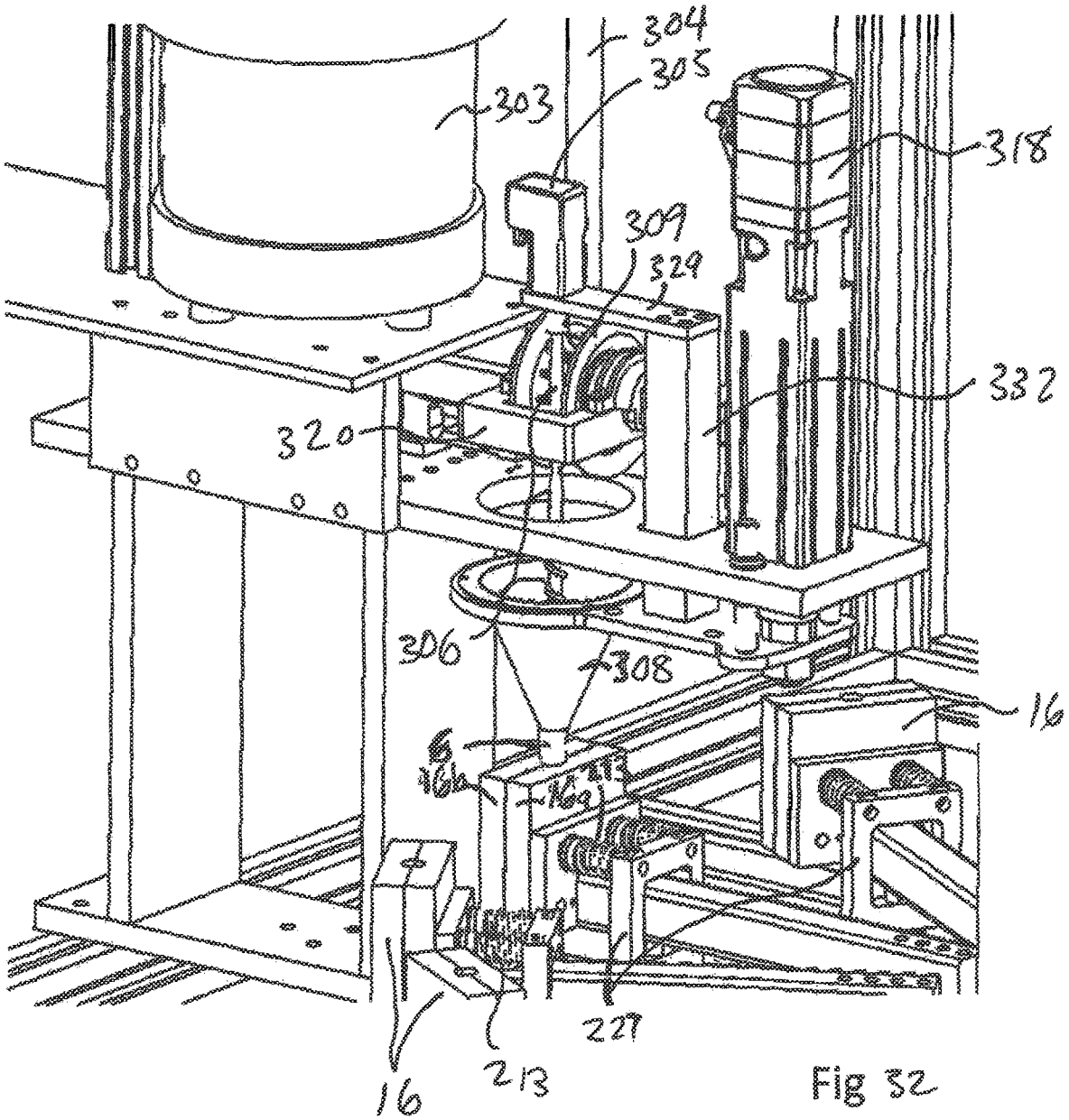
Figure 3:
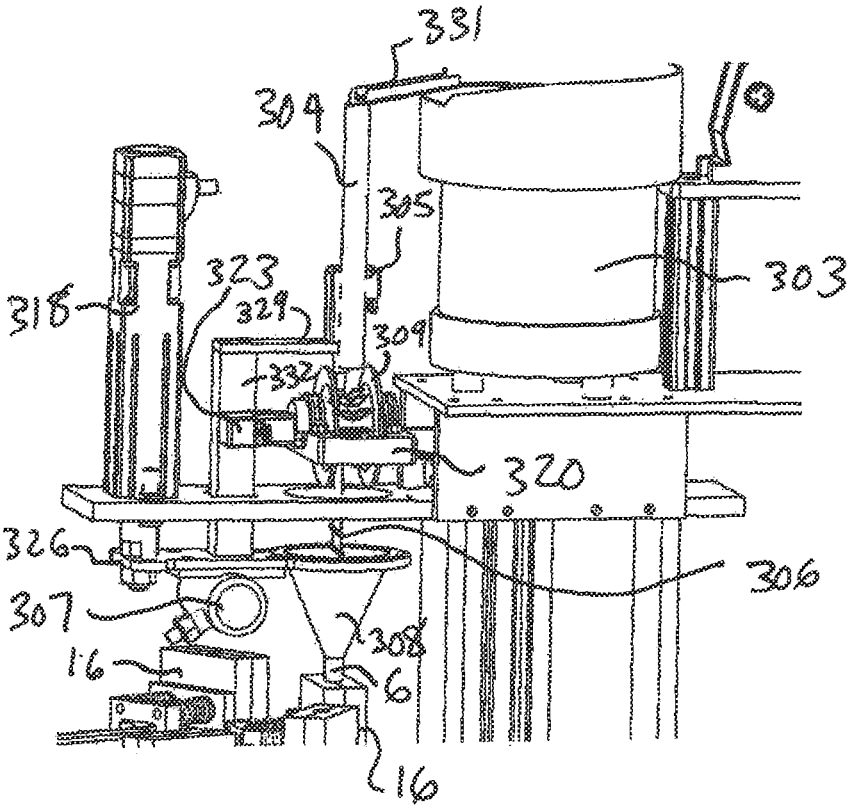
Figure 3:
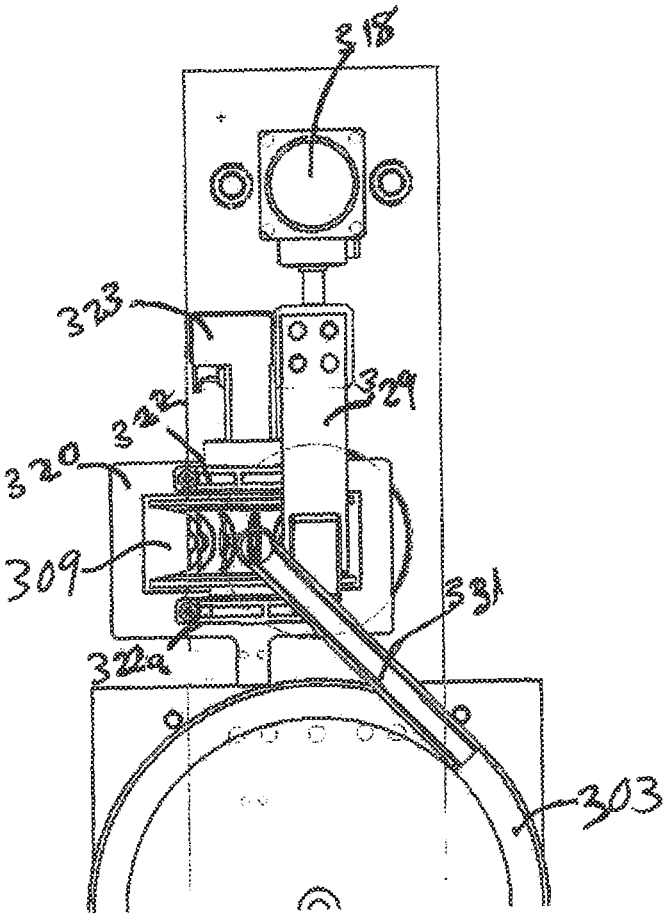
Figure 35:
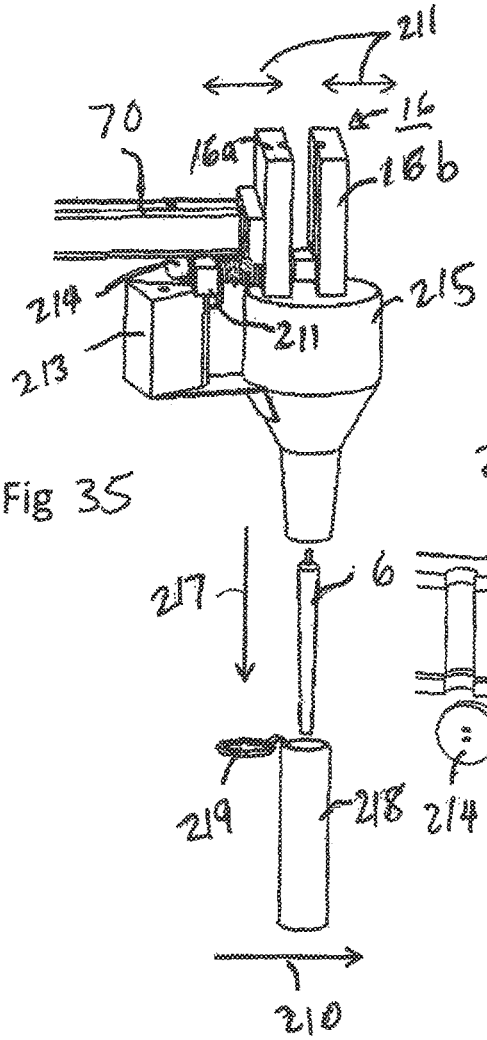
FIGS. 35 and 36 are isometric views of a twisted cone discharge and packaging station for use in the apparatus of FIG. 1.

FIG. 30 and FIGS. 31-32 are respective top and isometric views showing the weighing and filling station of FIGS. 26-29 together with the transport mechanism that moves the cones 6 into position for filling. As described above, the transport mechanism may include holders 16 and arms 70 extending from a turntable 5 that moves the holders 16 between cone loading stations 3, the weighing and filling stations shown in FIGS. 26-29, and cone twisting stations 4. Reference numeral 342 in FIG. 30 indicates a control panel and reference numeral 343 indicates a common apparatus frame. In addition, FIGS. 31 and 32 respectively depict the upper and lower positions of the oscillating funnel 308, and together with FIGS. 33 and 34 show an arm 329 and pillar 332 for connecting auger motor 305 to oscillating plate 329, and various parts of the holder opening mechanism, such as springs 213 and block 227, whose structure and function is described in more detail below in connection with FIGS. 37 and 38.

Figure 36:
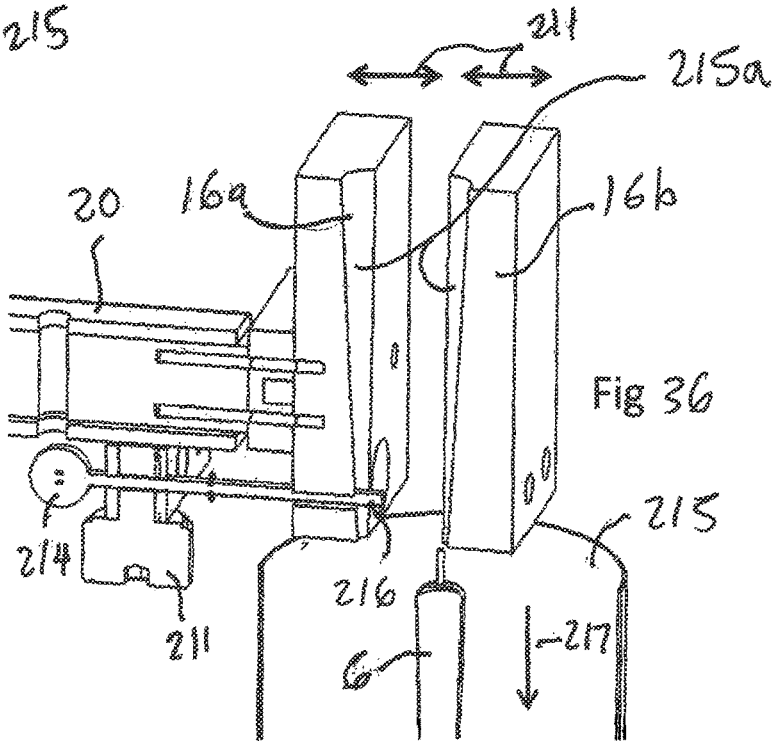

FIGS. 35-38 show a filled and twisted cone packaging station according to a preferred embodiment of the invention. After twisting using a mechanism such as the one illustrated in FIGS. 8-20, the cone 6 is transported by the arm 70 and split clamshell holder 16 to the packaging station, where the jaws 16*a* and 16*b* of the split clamshell holder 16 are opened in the direction of arrows 211, releasing the twisted cone 6 in direction 216 to drop into a funnel 215, and from the funnel 215 into a childproof packaging tube 218 having a lid 219. Opening of the split clamshell holder 16 may be accomplished by a stationary mechanical cam block 213 that strikes a slide bearing 211 to release a spring mechanism, shown in FIGS. 37 and 38, that causes the jaws of the holder 16 to move apart. In addition, as shown in FIG. 36, stationary cam block 213 is arranged to strike a release member 214 to extend a push pin 216 into the holder 16 against the biasing force of spring 231, causing push pin 216 to impact the twisted cone 6 and ensure that the cone 6 separates cleanly from the tapered inner surface 215*a* of the split clamshell holder 16 for gravity discharge into the funnel 215 in the direction of arrow 218.

Figure 37:
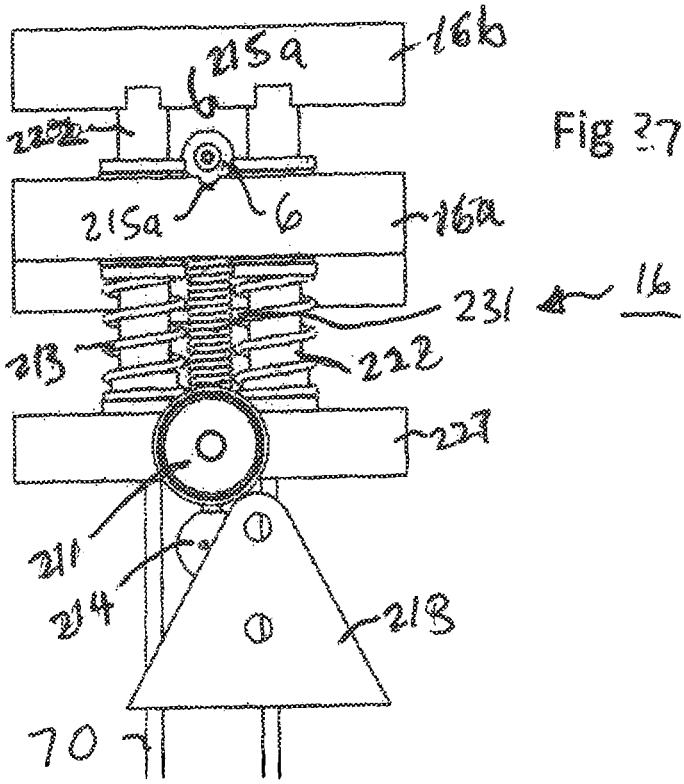
FIGS. 37 and 38 are plan views of a clamshell holder opening mechanism for using in the twisted cone discharge and packaging station of FIGS. 35 and 36.
Figure 38:
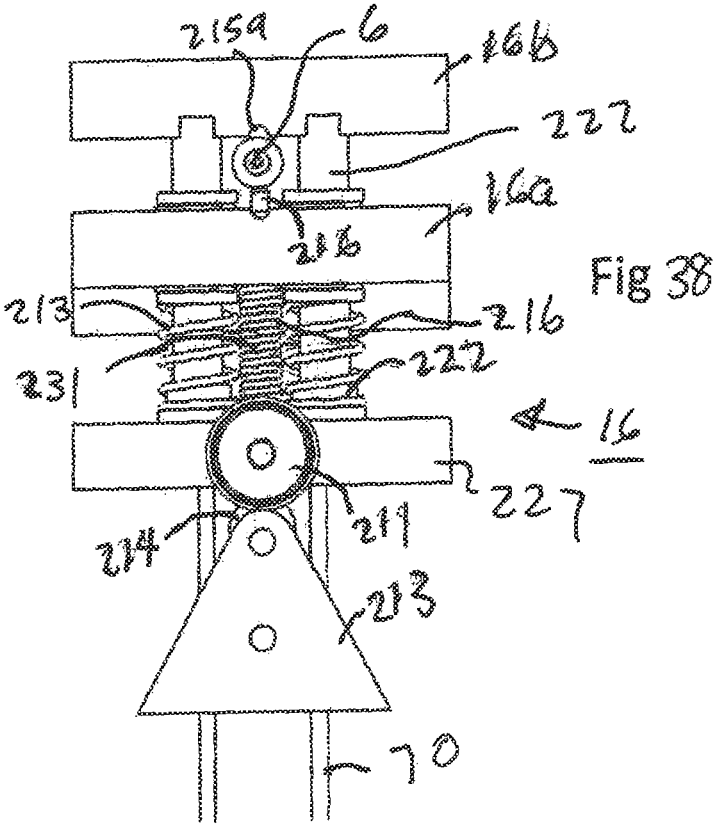

FIGS. 37 and 38 show details of the holder opening mechanism as viewed from below. As shown in FIG. 37, holder opening mechanism is actuated by engagement between the stationary cam block 213 and the slide bearing 211 as the holder 16 is moved into the cone discharge position. Slide bearing 211 is fixed to block 227, which is slidable with respect to transport arm 70. Movement of bearing 211 as it passes stationary cam block 213 causes movement of block 227, which is connected to jaw 16*b* by shafts 22 that extend through jaw 16*a*, thereby moving jaw 16*b* away from jaw 16*a* against the spring force provided by compression springs 213, opening the holder 16 and allowing the cone to drop into the funnel 215.

Figure 39:
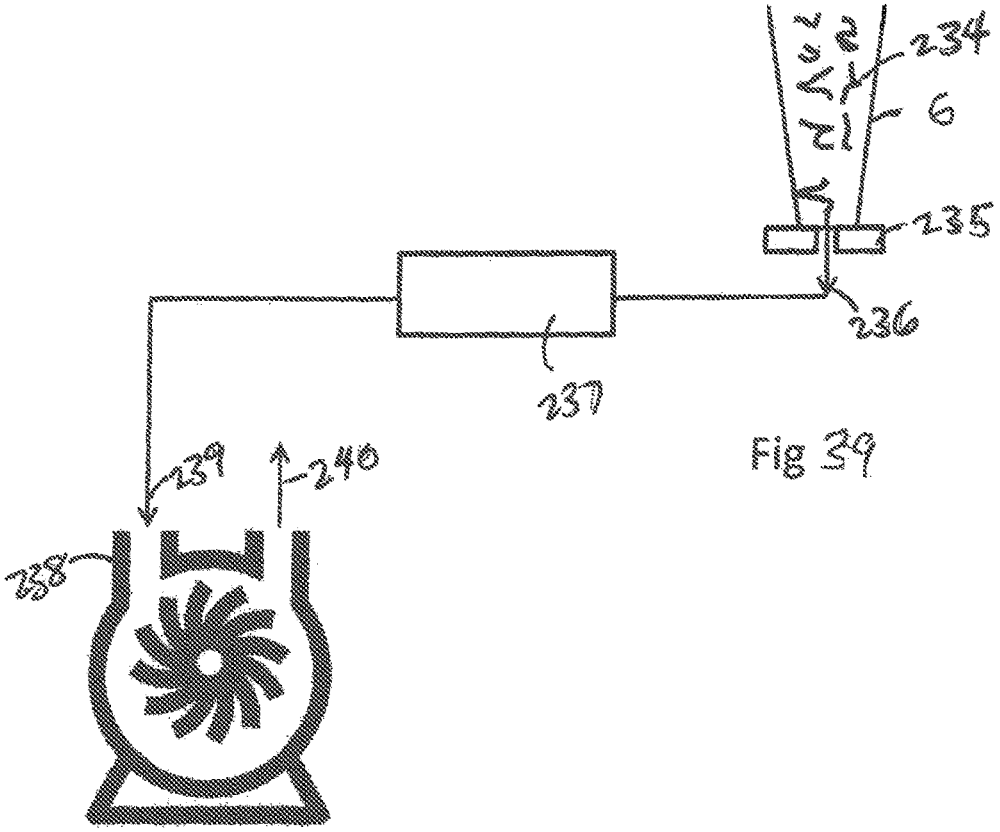
FIG. 39 is a schematic diagram of a vacuum assist system for use in the cannabis powder cone filling station of FIGS. 21-33.

FIG. 39 shows an optional vacuum system for increasing production speed by expediting transfer of biomass 234 into a cone 6 at the cone weighing and filling stations 1,2. The vacuum system may be used with the specific weighing and gravity-based loading mechanisms shown in FIGS. 21-34, or with other loading systems, and includes a vacuum pump 238 that pulls a vacuum from the bottom of the cone through an opening 235 in the cone holder and through a collection filter 237 in the direction of arrows 236, 239 and 240 as the cone 6 is vibrated to reduce the time it takes for irregular shapes of biomass 234 to settle into the cone.

As shown in FIG. 40, multiple cone loading stations 241, filling stations 242, and twisting stations 244 may be provided on a linear rather than circular conveyor with appropriate transport timing so as to further increase production capacity speed.

Figure 41:
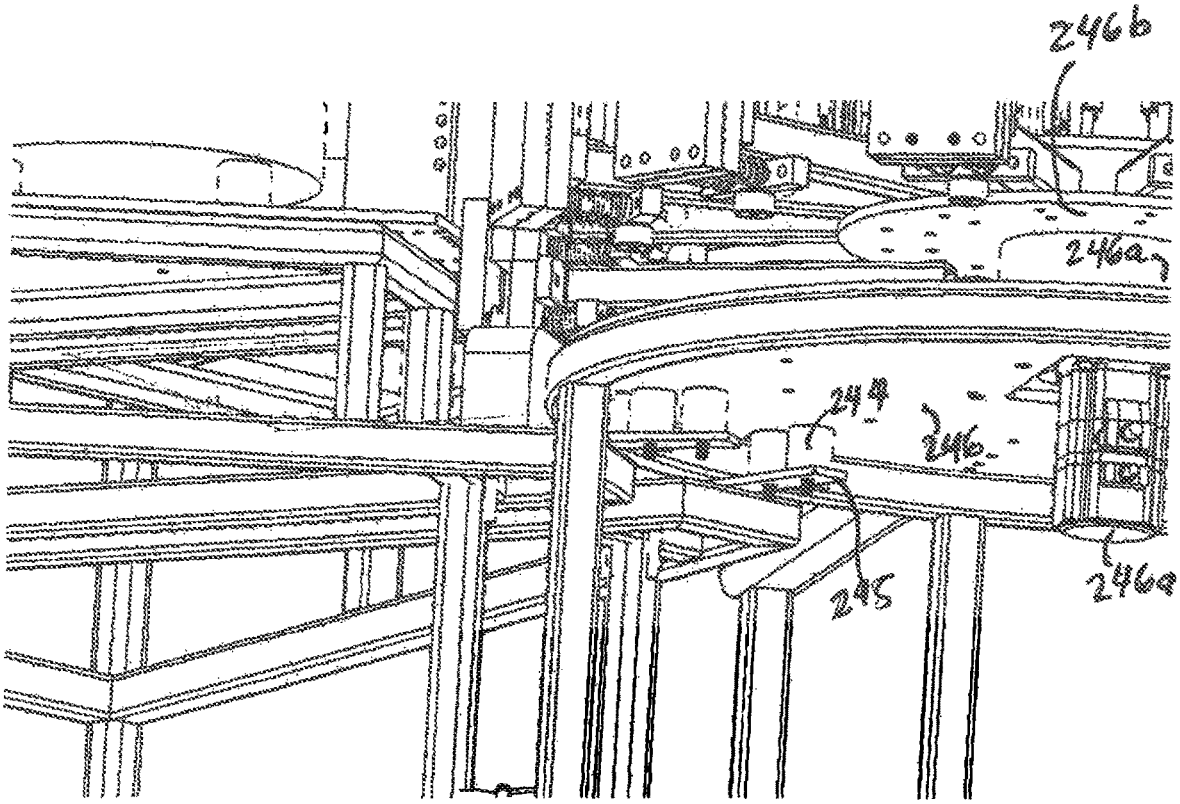
FIG. 41 is a perspective view, taken from below, of a cone transporting turntable for use in the apparatus of FIG. 1.

Alternatively, as shown in FIG. 41, the clamshell holders may be moved between stations by a rotating turntable 246*b* driven by a motor 246*a* position on a rotating table base 246 that includes a bearing stage 246*c* and weighing isolation alignment pads 244 mounted between weighing devices and table mounts 245,246.

Figure 42:
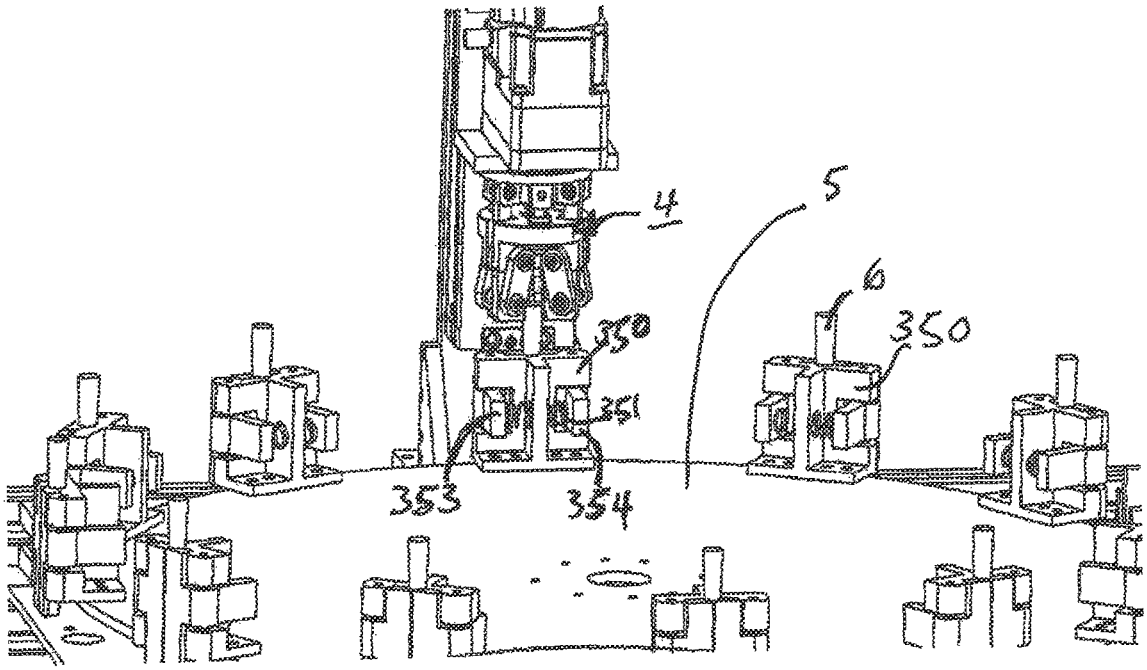
FIGS. 42-47 and 50 are isometric views of an alternative cone holding and transporting arrangement for the apparatus of FIGS. 1-41.
Figure 43:
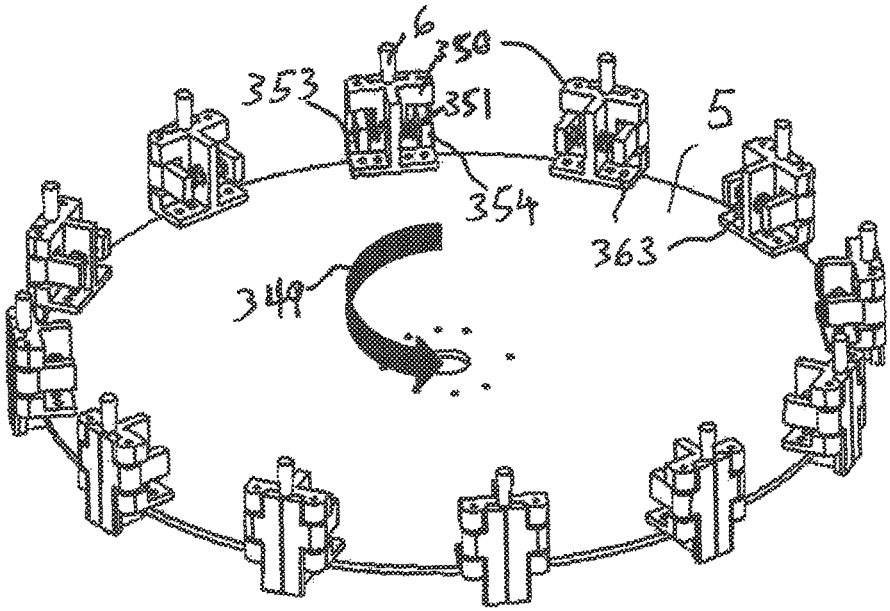

An alternative version of the cone transporting mechanism is illustrated in FIGS. 42-50. Instead of split clamshell holders 16 on arms 70 extending from the turntable 5, the cones 6 are held between tapper jaws 353 and 354 of spring loaded cone holders 350 mounted directly on the turntable. As illustrated in FIG. 42, one of the holders 350 is positioned at a twister station 4 having any of the twister mechanisms described above (or modifications thereof) for twisting the end of a filled cone 6. Transport of the cones 6 to and from the stations is accomplished by rotation of the turntable 5 in the direction indicated in FIG. 43 by arrow 349.

Figure 44:
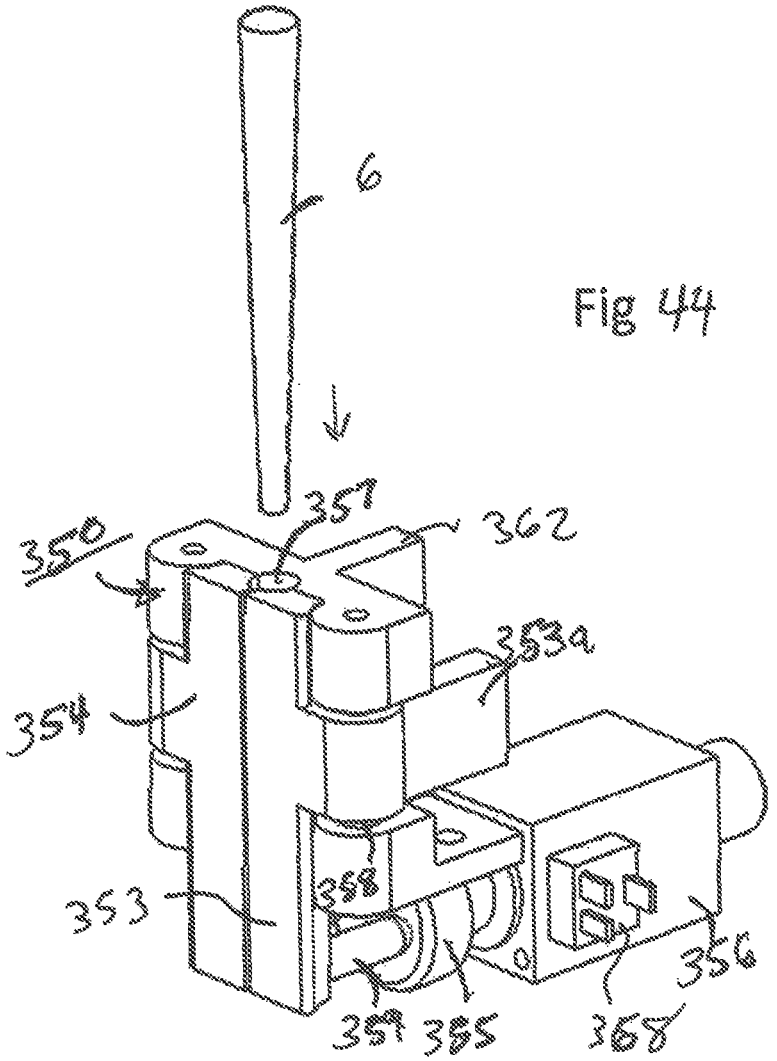
Figure 45:
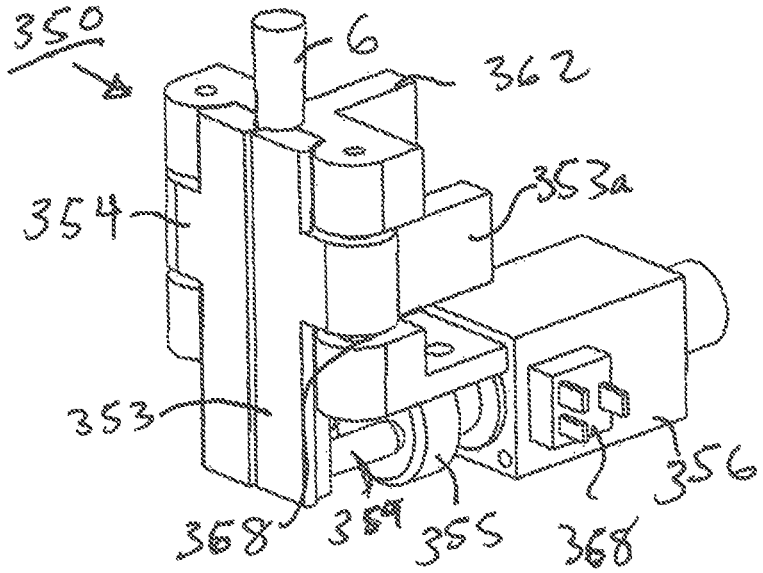
Figure 46:
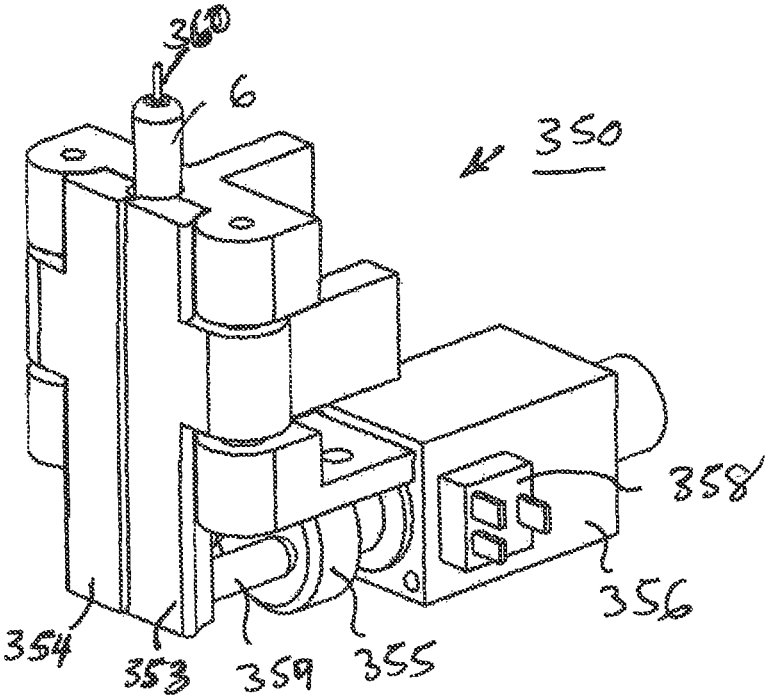
Figure 47:
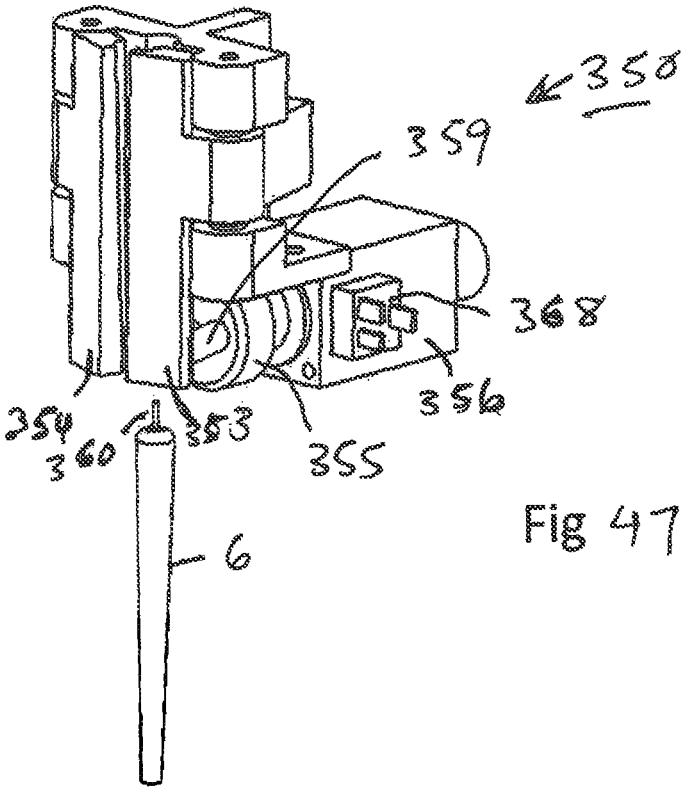

As illustrated in FIGS. 44 and 45, cones are loaded downwardly into openings 57 of holders 50 while the jaws 53 and 54 are in the closed position. The loading mechanism can be the same as described above in connection with FIGS. 2-7. The jaws 53 and 54 are held in the closed position, in which a respective cone is captured between the jaws and a main body of the holder 50, by the compression coil spring 351 shown in FIGS. 42, 43, 48, and 50. The arms 353 and 354 are mounted on pivot pins or hinges 358, and remain closed during cone loading, filling and twisting, as described above and indicated by the twisted end 360 of the cone 6 shown in FIG. 46. Following filling and twisting, the jaws 353 and 354 are opened by contact between an actuator 355 of solenoid 356 and a pin 359 extending from tapper arm 353, to release the finished, smokable cone 6 as illustrated in FIG. 47.

Figure 48:
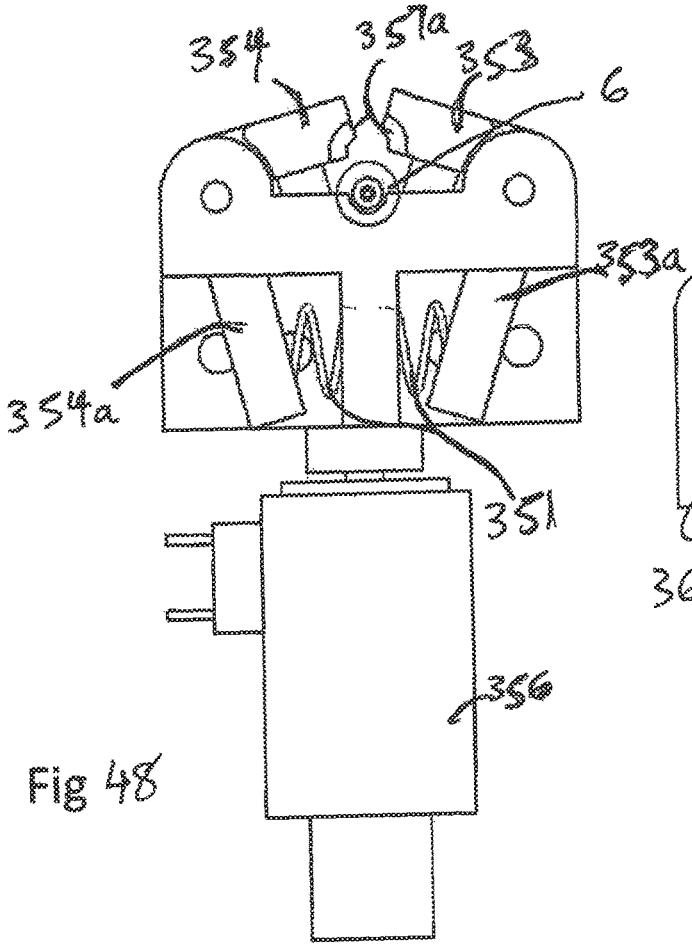
FIGS. 48 and 49 are respective top and bottom views of the cone holder of FIGS. 42-47 and 50.
Figure 49:
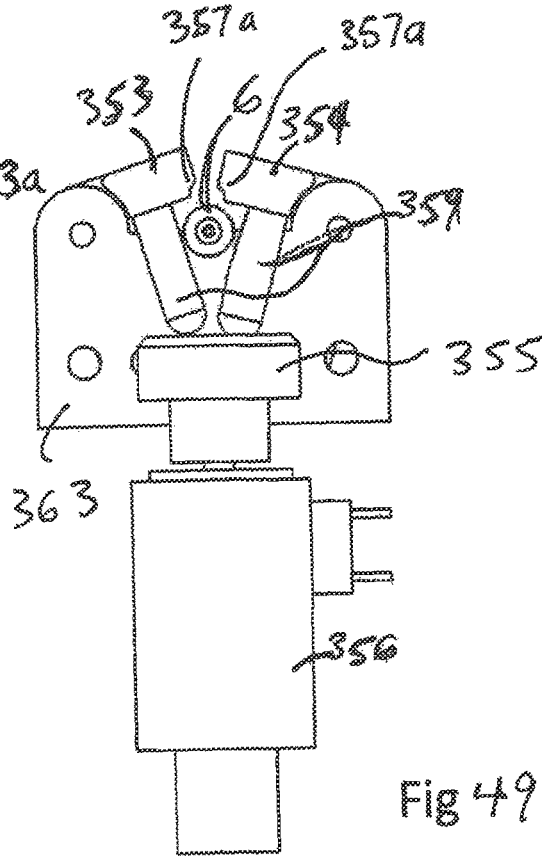
Figure 50:
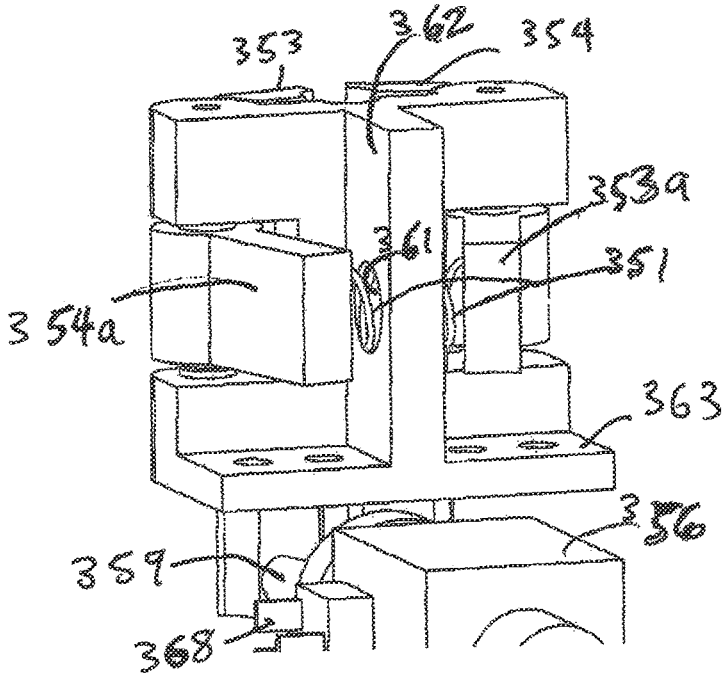

Compression coil spring 351 extends between rearward extensions 353*a* and 354*a* of the jaws 353 and 354 and through an opening 361 in bulkhead 362 extending rearwardly from the main body of holder 350, as is best shown in FIG. 50. As can be seen in FIG. 48, the cone holding ends 357*a* of the jaws 353 and 354 are shaped to form, together with a corresponding groove in the main body, a wall the opening 357 when the jaws are closed. The opening 357 is preferably cone shaped. Also, the holders 350 may including mounting plates 363 for directly fastening the holders to the turntable 5 using any appropriate fastener such as screws or nuts and bolts, and connectors 368 for supplying power to the solenoids 356.

Although a number of embodiments of the invention have been described in detail in connection with the accompanying drawings, it will be appreciated that modifications of the illustrated embodiments may be made without departing from the scope of the invention.

Figure 51:
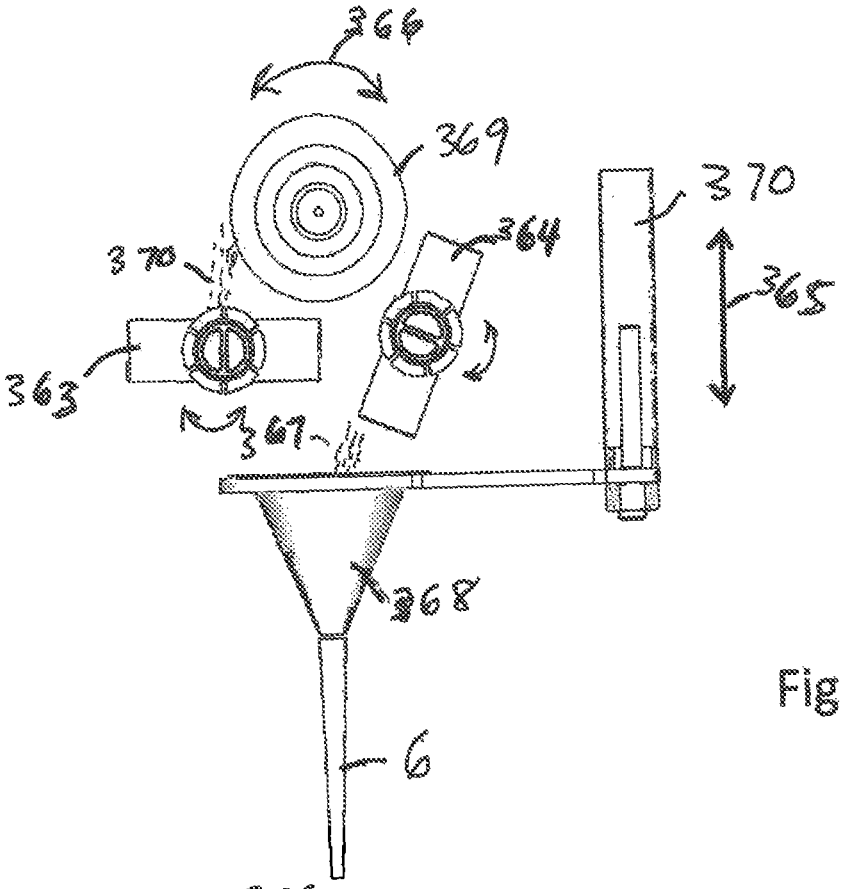
FIGS. 51 and 52 are schematic diagrams illustrating an alternative to the weighing and filling stations illustrated in FIGS. 21-34.
Figure 52:
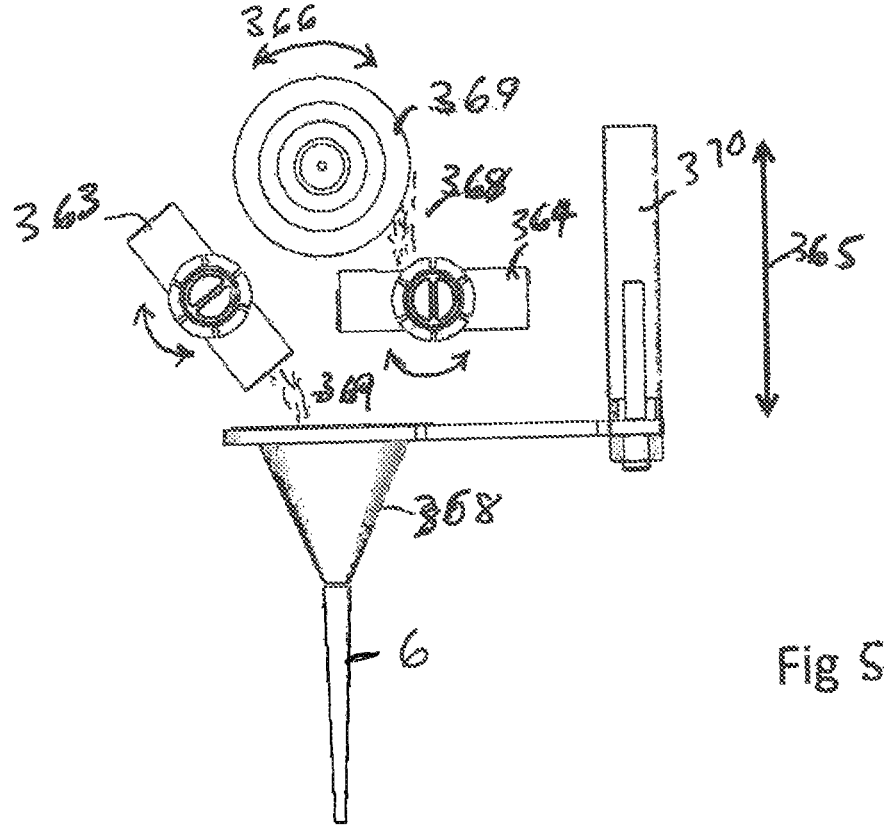

For example, as shown in FIGS. 51 and 52, the weighing and filling mechanisms described above in connection with FIGS. 21-34 may be replaced by a mechanism that uses a diverter wheel 369 driven to rotate in alternating clockwise and counterclockwise directions to alternately direct streams of powdered biomass 368 and 370 into two weighing stations in the form of load cell hoppers 363 and 364, which weigh the powdered biomass and alternately discharge weighed doses 367 and 369 into a funnel 308 driven by actuator 370 in direction 365 to enter cone 6 in a manner similar to that of the weighing and filling embodiments described in more detail above. In this embodiment, the diverter wheel 369 serves to control the flow of powdered biomass into the weighing stations 363 and 364, for example by uses a feedback loop between the rotating diverter 369 wheel, the load cell hoppers 363 and 364, and the linear actuator 370. Although two weighing stations are shown, it will be appreciated that the diverter wheel 369 may also be used to continuously control the flow of powdered biomass into a single weighing station.

Figure 53:
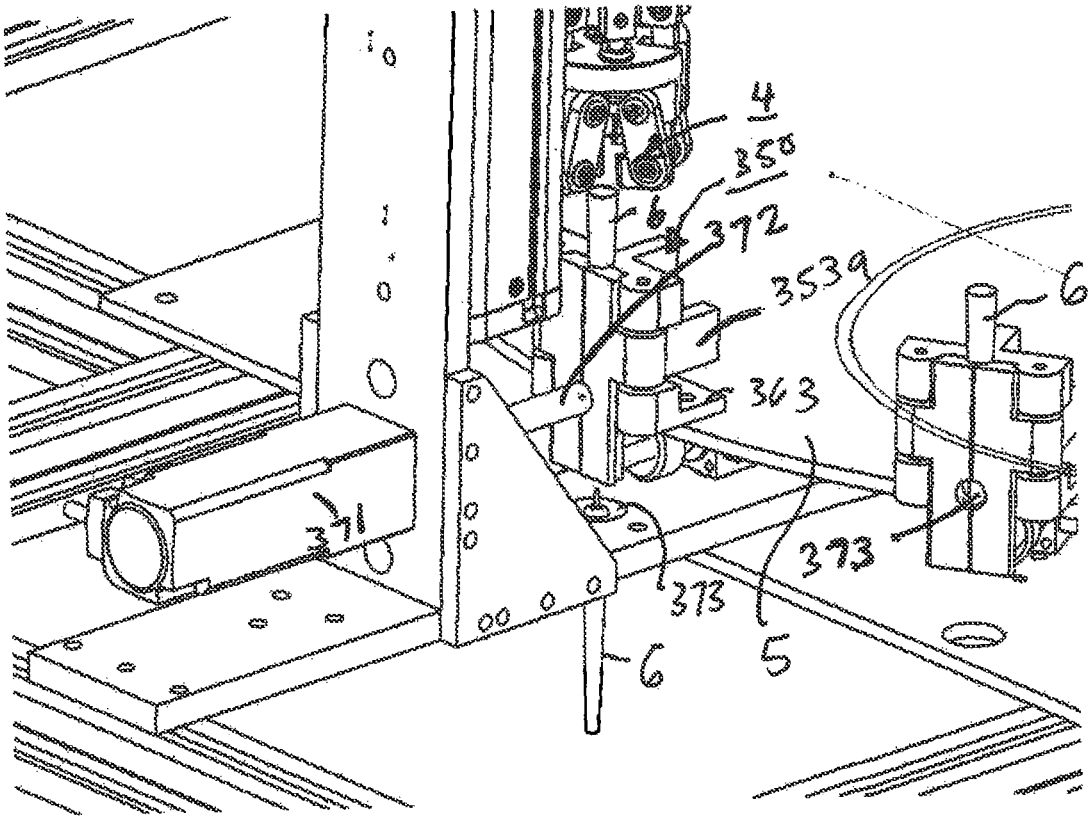
FIG. 53 illustrates an optional cone pinching arrangement to prevent rotation of a cone during twisting.

In another modification, illustrated in FIG. 53, the holders (illustrated by way of example and not limitation as holder 350 of the embodiment of FIGS. 42-50) may be modified to include an opening 373 for receiving a pinch shaft 372 driven by an actuator 371 to prevent the cone 6 from rotating when in the twisting station 4. FIG. 53 also shows another option in which the cone 6 is released and dropped through an opening 373 immediately after twisting, rather than being transported by the holder to a separate finished product dispensing station. These and other variations or modifications are intended to be included within the scope of the invention and, as a result, the invention is not to be limited by the above description or the accompanying drawings, but rather is to be defined solely in accordance with the appended claims.

What is claimed is:

1. An apparatus for mass production of a smokable product, comprising:

at least one holder device for holding and transporting a receptacle made of combustible material;

a first station at which an empty receptacle is filled with predetermined amounts of powdered biomass while being held in the at least one holder device; and a second station for finishing the smokable product by twisting an end of a filled receptacle while being held by the at least one holder device after the filled receptacle has been transported from the first station to the second station, wherein:

the receptacle is configured to be filled with powdered biomass through an open end, the first station includes a storage hopper for storing a quantity of powdered biomass, a first transfer mechanism for transferring powdered biomass from the storage hopper to a weighing structure, and a second transfer mechanism for transferring powdered biomass from the weighing structure to fill the empty receptacle, and the second station includes a twisting mechanism for closing the open end of the receptacle to retain the powdered biomass and complete the smokable product while the receptacle is held by the at least one holder device at the second station, wherein the receptacle is a paper cone, and wherein the twisting mechanism includes:

a plurality of jaws configured to grip an open end of a cone extending from the at least one holder device following movement of the at least one holder device to the second station, a linkage mechanism coupled to the plurality of jaws for causing the plurality of jaws to open and close, and three independently-controllable actuating devices, including:

a first actuating device including a twisting mechanism motor for causing rotation of the plurality of jaws of the twisting mechanism about a vertical axis to twist the open end of the cone as it is held by the plurality of jaws, a second actuating device including a linkage mechanism actuator for causing the linkage mechanism to open and close the plurality of jaws independently of said rotation of the plurality of jaws, and a third actuating device for moving the twisting mechanism, including the twisting mechanism motor, the linkage mechanism, the linkage mechanism actuator, and the plurality of jaws, in a vertical direction towards and away from the cone while the cone is held by the at least one holder device at the second station, wherein the twisting mechanism for closing the open end of the receptacle includes a force-limiting device that limits a twisting force applied by the twisting mechanism to the open end of the paper cone, to prevent tearing of the paper cone, said force-limiting device including a magnetic slip clutch included in a drive train of the twisting mechanism between the twisting mechanism motor and the plurality of jaws;

wherein the twisting mechanism operates as follows:

(i) the twisting mechanism is moved vertically downward to a position adjacent the open end of the paper cone while the plurality of jaws are open;

(ii) the plurality of jaws are closed at the same time to grip the open end of the paper cone;

(iii) the plurality of jaws are rotated around a vertical axis to twist the open end of the cone;

(iv) a twisting force of the twisting mechanism is limited by the magnetic slip clutch; and (v) the plurality of jaws are opened and the twisting mechanism is moved vertically upward to enable another paper cone to be moved by the at least one holder device into a position for twisting.

2. The apparatus as claimed in claim 1, wherein the powdered biomass is a powdered material containing cannabis, hemp, or a material derived therefrom.

3. The apparatus as claimed in claim 1, further comprising a third station including a loading mechanism for placing empty cones into the at least one holder device.

4. The apparatus as claimed in claim 3, wherein the loading mechanism includes a plurality of tubes for receiving stacks of said empty cones, a transport mechanism for moving the tubes to a loading position, and a gripper at the loading position for removing individual cones from a respective tube positioned at the third station to the at least one holder device, wherein each tube of the plurality of tubes includes an opening at a bottom of the tube, a diameter of the opening being selected to ensure removal from the tube of one cone at a time.

5. The apparatus as claimed in claim 4, wherein the gripper includes a pair of jaws and a first linear actuator for causing the pair of jaws to close and grip an end of the individual cone extending from the respective plurality of tubes, and a second linear actuator for moving the first linear actuator and the gripper from a top position adjacent the plurality of tubes to a bottom position adjacent the at least one holder device, wherein the pair of jaws are opened by the first linear actuator in the bottom position to release the cone to drop into a cone receiving opening in the at least one holder device.

6. The apparatus as claimed in claim 1, wherein a number of the plurality of jaws is three and the plurality of jaws are separated by 120 degree angles around a circumference of the cone.

7. The apparatus as claimed in claim 1, wherein the twisting mechanism comprises:

a first base plate connected to a hollow rotation shaft for rotation by the twisting mechanism motor; and a second base plate that is linearly movable relative to the first base plate in response to linear movement of a linear actuator shaft that extends through the hollow rotation shaft and the first base plate, wherein the linkage mechanism is connected to the first base plate and the second base plate and configured to convert relative vertical linear movement between the first and second base plates into radial opening and closing movement of the plurality of jaws.

8. The apparatus as claimed in claim 7, wherein the linkage mechanism comprises connecting rods and crank arms, wherein the plurality of jaws extend from or are fixed to the connecting rods and the connecting rods are pivotally attached to the first base plate, and wherein the crank arms are pivotally connected at opposite ends between the second base plate and respective connecting rods to cause the respective connecting rods to pivot and thereby open and close the plurality of jaws in response to the linear movement of the second base plate relative to the first base plate.

9. The apparatus as claimed in claim 8, further comprising a pin fixed to the first base plate and extending through a bearing in the second base plate to cause the second base plate to rotate with the first base plate while enabling the linear movement of the second base plate relative to the first base plate.

10. The apparatus as claimed in claim 8, wherein the plurality of jaws include friction pads attached to the connecting rods.

11. The apparatus as claimed in claim 7, wherein the linear actuator shaft is coupled to the second actuating device that controls opening and closing of the plurality of jaws.

12. The apparatus as claimed in claim 1, wherein the twisting mechanism comprises:

a base plate connected to a hollow rotation shaft for rotation by the twisting mechanism motor; and a hub that is linearly movable relative to the base plate in response to linear movement of a linear actuator shaft that extends through the hollow rotation shaft and the base plate, wherein the linkage mechanism is connected to the base plate and the hub and configured to convert relative vertical linear movement between the base plate and the hub into radial opening and closing movement of the plurality of jaws, and wherein the plurality of jaws extend from a plurality of connecting rods pivotally connected to the base plate, and wherein the linkage mechanism comprises a plurality of cam slots in the hub and a plurality of cam followers fixed to the connecting rods and extending into the plurality of cam slots to cause the respective connecting rods to pivot and thereby open and close the plurality of jaws in response to the linear movement of the hub relative to the base plate.

13. The apparatus as claimed in claim 12, wherein the linear actuator shaft is a rotating screw shaft that extends from the second actuating device to a screw follower in the hub to cause said relative linear movement of the hub relative to the base plate in response to rotation of the screw shaft by the second actuating device.

14. The apparatus as claimed in claim 12, further comprising at least one pin extending from the base plate and at least one bearing wheel rotatably mounted on the at least one pin to engage the hub and cause the hub to rotate with the base plate while permitting relative movement between the base plate and the hub to open and close the plurality of jaws.

15. The apparatus as claimed in claim 1, wherein the plurality of jaws are spring-loaded to control a gripping force applied by the plurality of jaws to the cone during twisting.

16. The apparatus as claimed in claim 1, wherein the second station further includes a pinch pin arranged to extend through an opening in the at least one holder device when the at least one holder device is at the second station to prevent rotation of the cone during twisting.

17. The apparatus as claimed in claim 1, wherein the at least one holder device is a split clamshell holder that includes a first jaw fixed to an arm extending from a turntable, and a second jaw that is slidable relative to the first jaw, wherein the second jaw is biased toward the first jaw by at least one spring, the first and second jaws each including a groove that together form an opening for receiving the receptacle.

18. The apparatus as claimed in claim 17, wherein the at least one holder device further includes a slidable block coupled to the second jaw by a shaft extending through the first jaw, wherein:

a compression coil spring surrounds the shaft and extends between the slidable block and the second jaw to bias the second jaw towards the first jaw, and a cam bearing is mounted on the slidable block to cause the second jaw to move away from the first jaw and release a filled and twisted cone held between the first and second jaws, the release being caused by engagement between the cam bearing and a fixed cam block as the at least one holder device is moved by the turntable into a releasing position following completion of twisting and transport from the second station.

19. The apparatus as claimed in claim 18, wherein the filled and twisted cone is released into a childproof package situated below the releasing position.

20. The apparatus as claimed in claim 18, further comprising a pin having a pin ball at one end and that extends through the slidable block and the first jaw such that a second end of the pin enters the opening in the at least one holder device when the pin ball encounters the fixed cam block to assist in release of the filled and twisted cone from the at least one holder device.

21. The apparatus as claimed in claim 1, wherein the at least one holder device includes a main body and a pair of pivoting jaws that close to capture the cone in an opening formed between the pair of pivoting jaws and the main body.

22. The apparatus as claimed in claim 21, wherein the pair of pivoting jaws are held in a closed position by a compression coil spring extending between arms of the pair of pivoting jaws, and opened by a solenoid mechanism to pivot the pair of pivoting jaws to an open position against a force of the compression coil spring and release a filled and twisted cone from the opening.

23. The apparatus as claimed in claim 21, wherein the at least one holder device is fixed directly to a turntable for transporting the at least one holder device between stations.

24. The apparatus as claimed in claim 1, wherein the first station includes an auger that extends through a funnel to impart a rotational motion to powdered biomass being dispensed through the funnel and into the receptacle.

25. The apparatus as claimed in claim 24, wherein the rotational motion is in a direction of a Coriolis force.

26. The apparatus as claimed in claim 24, wherein the first station further includes a clog-preventing vibrator arranged to vibrate the funnel as powdered biomass passes through the funnel to be dispensed into the receptacle.

27. The apparatus as claimed in claim 1, wherein the first station includes a clog-preventing vibrator arranged to vibrate a funnel included in the second transfer mechanism as powdered biomass passes through the funnel to be dispensed into the receptacle.

28. The apparatus as claimed in claim 27, wherein the clog-preventing vibrator is a tube and the funnel is mounted on a plate that is movable up and down by a linear actuator to raise and lower the plate, the plate resting on the tube while in a lower position to enable vibration of the plate and funnel when the funnel extends into the receptacle for filling.

29. The apparatus as claimed in claim 1, further comprising a vacuum device coupled to the at least one holder device when the at least one holder device is at the first station for pulling powdered biomass into the receptacle.

* * * * *